US008083059B1

(12) United States Patent
Wessel, IV

(10) Patent No.: US 8,083,059 B1
(45) Date of Patent: Dec. 27, 2011

(54) SOCKET STORAGE APPARATUS

(76) Inventor: Homer A. Wessel, IV, Royal Palm Beach, FL (US)

( * ) Notice: Subject to any disclaimer, the term of this patent is extended or adjusted under 35 U.S.C. 154(b) by 280 days.

(21) Appl. No.: 12/508,720

(22) Filed: Jul. 24, 2009

Related U.S. Application Data

(60) Provisional application No. 61/083,180, filed on Jul. 24, 2008.

(51) Int. Cl.
*B65D 85/20* (2006.01)

(52) U.S. Cl. ..... 206/378; 206/379; 206/372; 211/70.6

(58) Field of Classification Search ..... 206/378, 206/377, 376, 372, 373, 379; 211/70.6, 69.5, 211/69; 248/346.01, 346.03, 111, 314
See application file for complete search history.

(56) References Cited

U.S. PATENT DOCUMENTS

| | | | | |
|---|---|---|---|---|
| 5,222,610 | A * | 6/1993 | Johansen et al. | 211/69.5 |
| 5,570,784 | A * | 11/1996 | Sidabras et al. | 206/378 |
| 5,839,579 | A * | 11/1998 | Lee | 206/378 |
| 5,884,755 | A * | 3/1999 | Vaccarella | 206/84 |
| 6,595,375 | B2 * | 7/2003 | McConnell | 211/70.6 |
| 6,637,605 | B2 * | 10/2003 | Ernst | 211/70.6 |
| 7,461,751 | B2 * | 12/2008 | Lyons | 211/85.13 |
| 2003/0019775 | A1 * | 1/2003 | Ernst | 206/378 |
| 2003/0222036 | A1 * | 12/2003 | Lacombe et al. | 211/70.6 |
| 2004/0188366 | A1 * | 9/2004 | Tong | 211/70.6 |
| 2006/0151406 | A1 * | 7/2006 | Hsien-Chung et al. | 211/70.6 |
| 2007/0102381 | A1 * | 5/2007 | Nguy et al. | 211/70.6 |

FOREIGN PATENT DOCUMENTS

WO WO 8401121 A1 * 3/1984

* cited by examiner

*Primary Examiner* — David Fidei
(74) *Attorney, Agent, or Firm* — Gold & Rizvi, P.A.; Glenn E. Gold; H. John Rizvi

(57) ABSTRACT

A socket storage apparatus is disclosed. An illustrative embodiment of the socket storage apparatus includes at least one generally elongated socket support member and a plurality of socket attachment devices carried by the at least one socket support member in generally spaced-apart relationship with respect to each other. A pair of spaced-apart base panels is disposed at each end of the elongated socket support member. The base panels have a perimeter including a supporting edge, which extends beyond a distal end of either a series of sockets or other drive tool. The socket storage apparatus can include a magnet, a hook, or both for temporarily securing the apparatus to another object.

17 Claims, 38 Drawing Sheets

300a
301
302
302
302

SOCKET STORAGE APPARATUS

CROSS-REFERENCE TO RELATED APPLICATION

This Application is a Non-Provisional Application, which claims priority to the following co-pending U.S. Provisional Application Ser. No. 61/083,180, filed on Jul. 24, 2008; in the name of the same inventor, and which is incorporated in its entirety herein.

FIELD OF THE INVENTION

The present invention relates to socket wrenches. More particularly, the present invention relates to a storage apparatus, which is suitable for storing drive tools, sockets of a socket wrench, and socket accessories, in an organized and accessible manner.

BACKGROUND OF THE INVENTION

Various types of tools are known for the tightening and loosening of bolts and nuts and like fasteners. Common types of tools used for this purpose include manual and automatic screwdrivers and various types of wrenches. Crescent wrenches and socket wrenches are common types of wrenches. A crescent wrench includes an elongated handle with a crescent-shaped head having a squared slot or opening. In the case of an adjustable crescent wrench, the opening is adjustable in size typically by rotation of a threaded thumbscrew. In the case of a fixed-size crescent wrench, the opening is a fixed size. Multiple fixed-sized crescent wrenches having openings of various sizes may be available in a set of the crescent wrenches to facilitate tightening and loosening of bolts and nuts having various sizes.

A socket wrench typically includes an elongated handle one end of which is fitted with a ratchet assembly. Cylindrical sockets having socket openings of various sizes are removably and individually attached to a male connector element, which extends from the ratchet assembly. The socket opening of each socket may have a hexagonal shape or may include multiple interior ridges or teeth adapted to engage the flats on a bolt or nut. A directional selector on the ratchet assembly facilitates selection of the direction of rotation of the socket for incremental tightening or loosening of the bolt or nut when the socket is attached to the ratchet assembly. Therefore, because there is no need to disengage and re-engage the socket with the bolt or nut preparatory to each turn, the socket wrench imparts ease, convenience and flexibility to the bolt tightening and loosening procedure.

Because the sockets of a socket wrench set are various sizes, it is important to maintain organization of the sockets in the set in such a manner that the proper socket can be selected for attachment to the ratchet assembly of the socket wrench when a socket of a particular size is needed. Conventionally, the sockets may be arranged in order of ascending or descending size in a toolbox or the like. However, the sockets must frequently be selected when the user is working in a physically confined area such as beneath an automobile, for example. Therefore, it may be difficult for the user to readily identify and select a socket having the desired size within a confined area.

Therefore, a socket storage apparatus is needed which is suitable for storing sockets of a socket wrench in an organized and accessible manner and particularly in a manner in which a socket of a desired size can be expeditiously identified and selected in a physically confined area.

SUMMARY OF THE INVENTION

The present invention is generally directed to a storage apparatus, which is suitable for storing sockets of a socket wrench in an organized and accessible manner. The storage apparatus is particularly suitable for storing a set or plurality of sets of socket wrench sockets, drive tools, and accessories in such a manner that a socket of a desired size can be expeditiously identified and selected in a physically confined area.

In one aspect of the invention, the socket storage apparatus comprises:

at least one generally elongated socket support member; and a plurality of socket attachment devices carried by the at least one socket support member in generally spaced-apart relationship with respect to each other.

In yet another aspect of the invention, the plurality of socket attachment devices may include a plurality of socket support brackets.

In another aspect of the invention, the plurality of socket attachment devices may include a plurality of grommet openings provided in the at least one socket support member and a plurality of socket grommets provided in the plurality of grommet openings, respectively, and having a plurality of socket openings, respectively.

In yet another aspect of the invention, the plurality of socket attachment devices may include a plurality of socket openings provided in the at least one socket support member.

In still another aspect of the invention, the plurality of socket attachment devices may include a plurality of adaptor holders carried by the at least one socket support member and a plurality of adaptors carried by each of the plurality of adaptor holders.

In another aspect of the invention, the plurality of socket attachment devices may include a plurality of bracket slots provided in the at least one socket support member and a plurality of socket support brackets engaging the plurality of bracket slots.

In yet another aspect of the invention, each of the plurality of socket support brackets may include a generally curved bracket body and a pair of bracket flanges extending from the bracket body and engaging a pair of the plurality of bracket slots.

In a still further aspect of the invention, the plurality of socket attachment devices may include a plurality of adaptor openings provided in the socket support member and a plurality of adaptors inserted in the plurality of adaptor openings, respectively.

In yet another aspect of the invention, the plurality of socket attachment devices may include a plurality of bracket slots provided in the at least one socket support member and a plurality of connector blocks having a plurality of socket cavities, respectively, engaging the plurality of bracket slots.

In another aspect of the invention, the plurality of socket attachment devices may include a plurality of socket tool cavities provided in the socket support member.

In still another aspect of the invention, the plurality of socket attachment devices may include a plurality of bracket slots provided in the at least one socket support member and a plurality of socket tool clips engaging the plurality of bracket slots and having a plurality of clip cradles, respectively.

While another aspect includes a hook for hanging the socket storage apparatus on an object.

In yet another aspect, the socket storage apparatus can include at least one magnet for securing the apparatus to a magnetic object.

And yet another aspect incorporates a "C" shaped frame having a base and a pair of end walls. The socket supporting member is assembled, spanning between the pair of end walls.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the Figures, the present invention is generally directed to a storage apparatus, which is suitable for storing sockets of a socket wrench in an organized and accessible manner. The storage apparatus is particularly suitable for storing a set of socket wrench sockets in such a manner that a socket of a desired size can be expeditiously identified and selected in a physically confined area.

Figure 1:
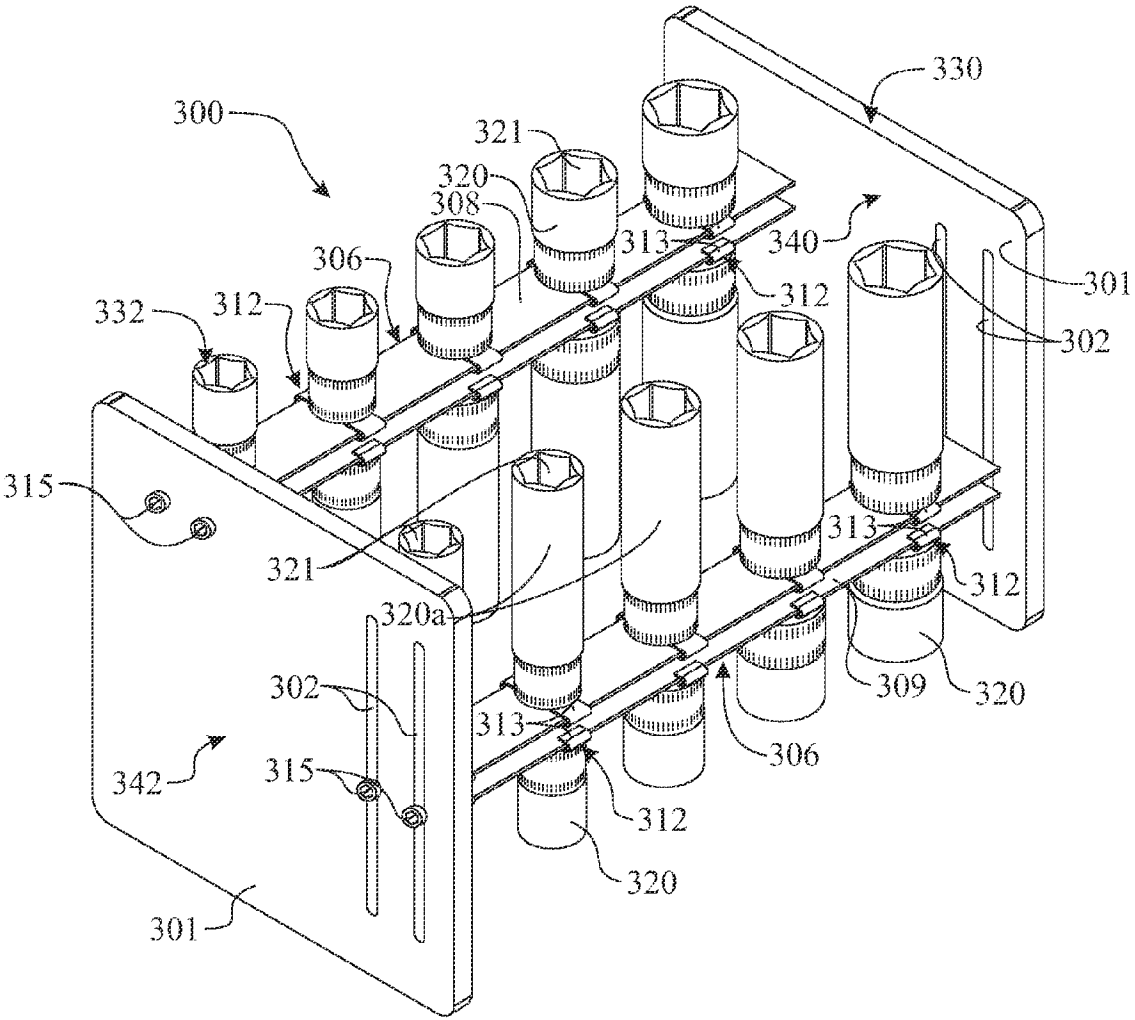
FIG. 1 is a front perspective view of an illustrative embodiment of a socket storage apparatus according to the present invention, with multiple sockets of a socket wrench set having various sizes attached to the apparatus.
Figure 2:
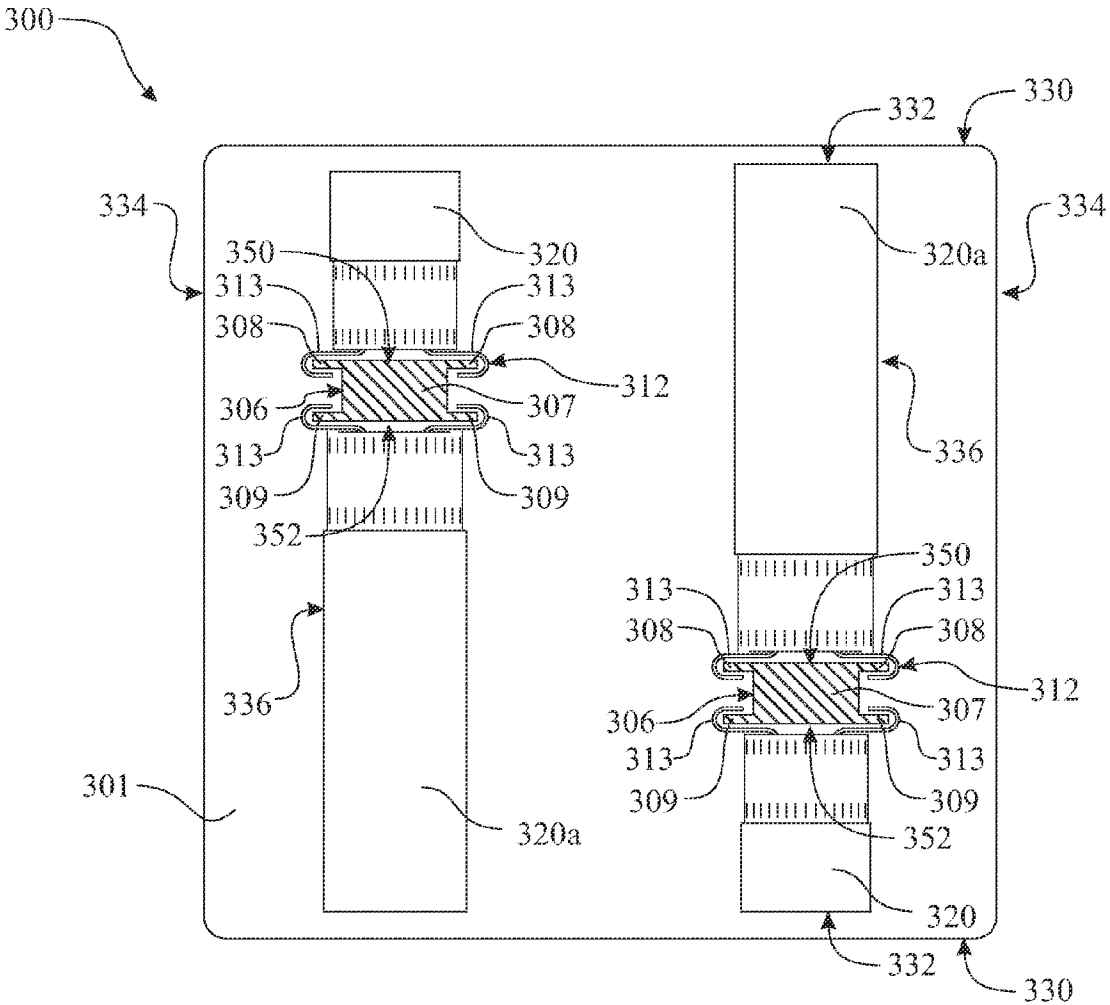
FIG. 2 is a cross-sectional view of the socket storage apparatus illustrated in FIG. 1.

Referring initially to FIGS. 1-11 of the drawings, an illustrative embodiment of the socket storage apparatus according to the present invention is generally indicated by reference numeral 300 in FIGS. 1 and 2. The socket storage apparatus 300 includes a pair of generally spaced-apart, parallel base panels 301, each of which may have a generally rectangular shape. At least one socket support platform 306 extends between and is supported by the base panels 301. In some embodiments, a pair of socket support platforms 306 extends between the base panels 301, as illustrated. The base panels 301 have an interior surface 340 and an exterior surface 342 separated by a multi-sided perimeter edge. The multi-sided perimeter edge is shown having a pair of horizontal supporting edges 330 and a pair of vertical supporting edge 336. The horizontal supporting edge 330 extends beyond a distal edge 332 of the tallest socket 320 on each of an upper side 350 and a lower side 352 of the support platform 306. The horizontal supporting edge 330 ensures the sockets 320 remain engaged with the respective socket support platform 306 during use. In the preferred embodiment, the base panels 301 are sized such to support a standard or shallow socket 320 on a first side of the socket support platforms 306 and a deep socket 320*a* on an opposing side of the socket support platforms 306. The socket support platforms 306 can be provided to engage with a variety of socket drive sizes, including SAE (standard or imperial tool sized standards) ¼ ", ⅜", and ½", the metric equivalents, and the like. Additionally, the socket support platforms 306 can provide support for extensions, socket wrenches, and the like, which will be described in more detail later herein.

In addition to the horizontal supporting edge 330, a vertical supporting edge 334 is provided. The vertical supporting edge 334 extends beyond each furthest socket sidewall edge 336 of each of the largest diameter sockets 320 stored on the socket support platforms 306. The outer tangent 336 is the respective tangential edge of the socket 330 closest to the vertical supporting edge 334. This configuration provides protection and additional storage retention to the socket 320 while stored within the socket storage apparatus. When the socket storage apparatus is placed on the vertical supporting edge 334, the sockets 320 are not contacting the surface and therefore are less likely to get scratched or become dislodged from the socket support platforms 306. Similarly, when the socket storage apparatus is placed on the horizontal supporting edge 330, the sockets 320 are also, not contacting the surface and therefore are less likely to get scratched or become dislodged from the socket support platforms 306.

Providing the socket support platforms 306 spanning between the pair of generally spaced-apart, parallel base panels 301 provides the user with access to the sockets from virtually any angle. Backyard mechanics do not have the luxurious equipment, such as a lift and are normally forced to work in tight quarters. This is an example of where tool handling and access an important factor when considering a tool (socket in this case) storage apparatus.

Each socket support platform 306 may be attached to each base panel 301 according to any suitable technique, which is known by those skilled in the art. In some embodiments, at least one socket support platform 306 is adjustably mounted between the base panels 301. Accordingly, a pair of generally parallel, spaced-apart support platform adjustment slots 302 extends through each base panel 301. A pair of platform fasteners 315, each of which may be an Allen screw, for example and without limitation, extends through each respective pair of support platform adjustment slots 302 and is threaded into a pair of respective platform fastener openings 310 (FIG. 11) provided in each corresponding end of the socket support platform 306. Each pair of platform fasteners 315 may be selectively loosened and slid along the corresponding pair of support platform adjustment slots 302 to facilitate vertical adjustment of the socket support platform 306. Each pair of platform fasteners 315 may be selectively tightened to facilitate securing of the socket support platform 306 at a selected height or vertical position between the base panels 301. Alternately to a pair of support platform adjustment slots 302, a series of holes can be disposed therein, facilitating adjustability of the socket support platform 306.

At least one of the socket support platforms 306 may be fixedly mounted between the base panels 301. Accordingly, a pair of platform fasteners 315 extends through a pair of fastener openings (not illustrated) provided in each base panel 301 and is threaded into a registering pair of respective platform fastener openings 310 (FIG. 11) provided in each corresponding end of the socket support platform 306.

Figure 3:
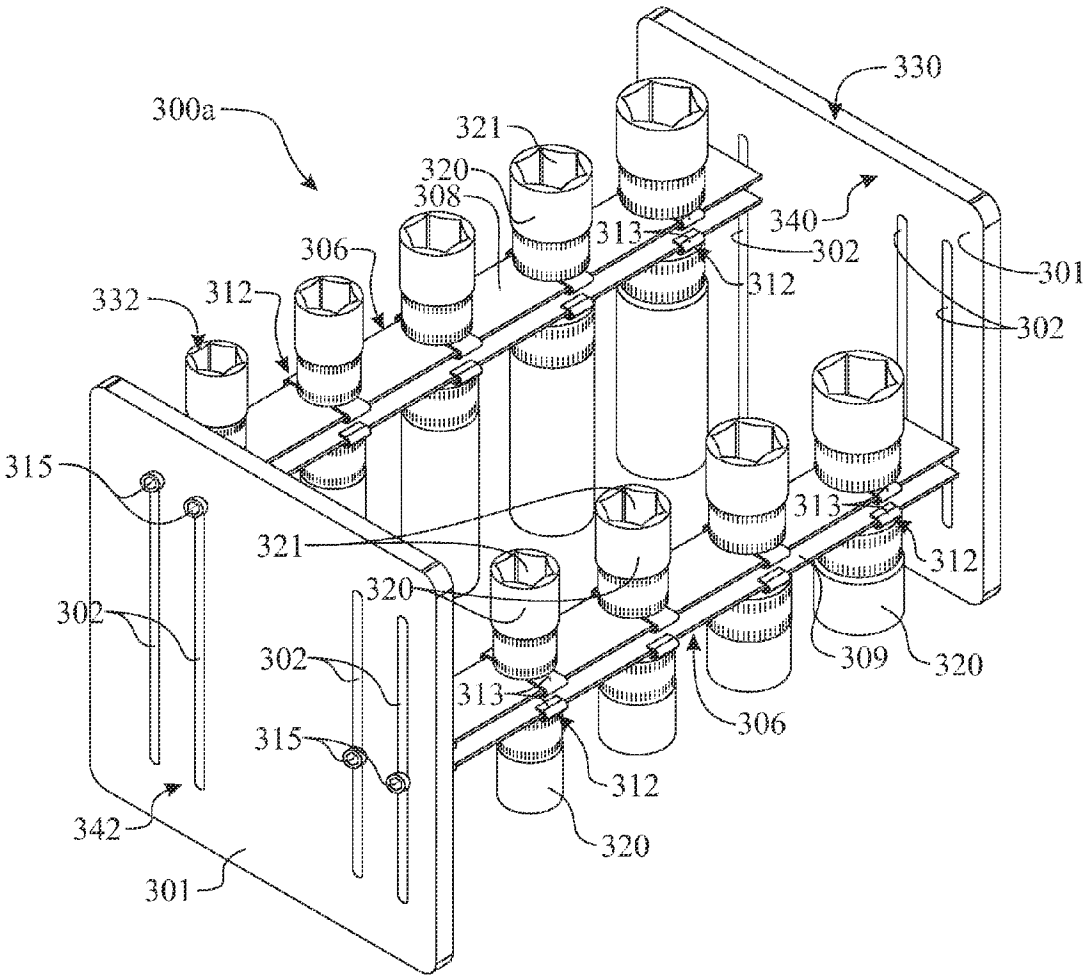
FIG. 3 is a front perspective view of an alternative illustrative embodiment of the socket storage apparatus, with multiple sockets of a socket wrench set having various sizes attached to the apparatus.
Figure 4:
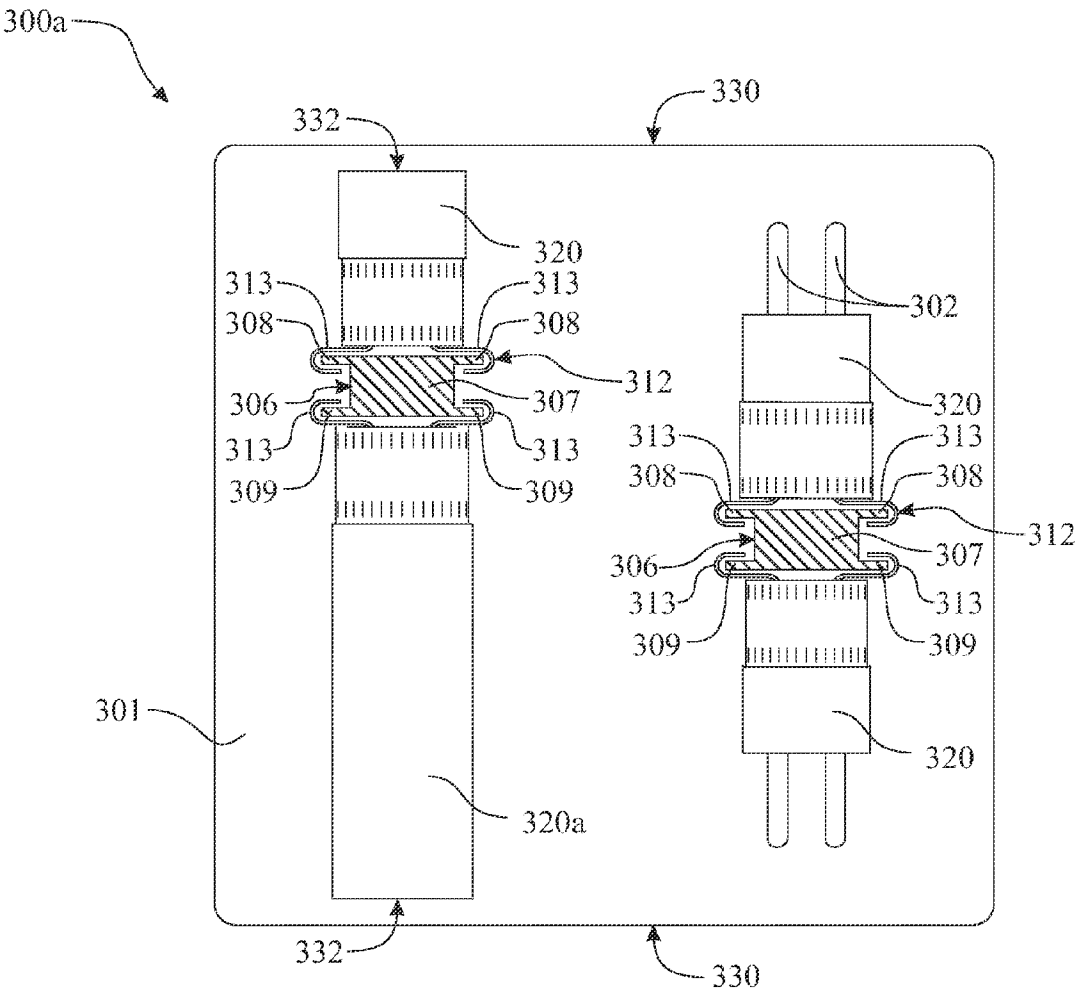
FIG. 4 is a cross-sectional view of the socket storage apparatus illustrated in FIG. 3.
Figure 5:
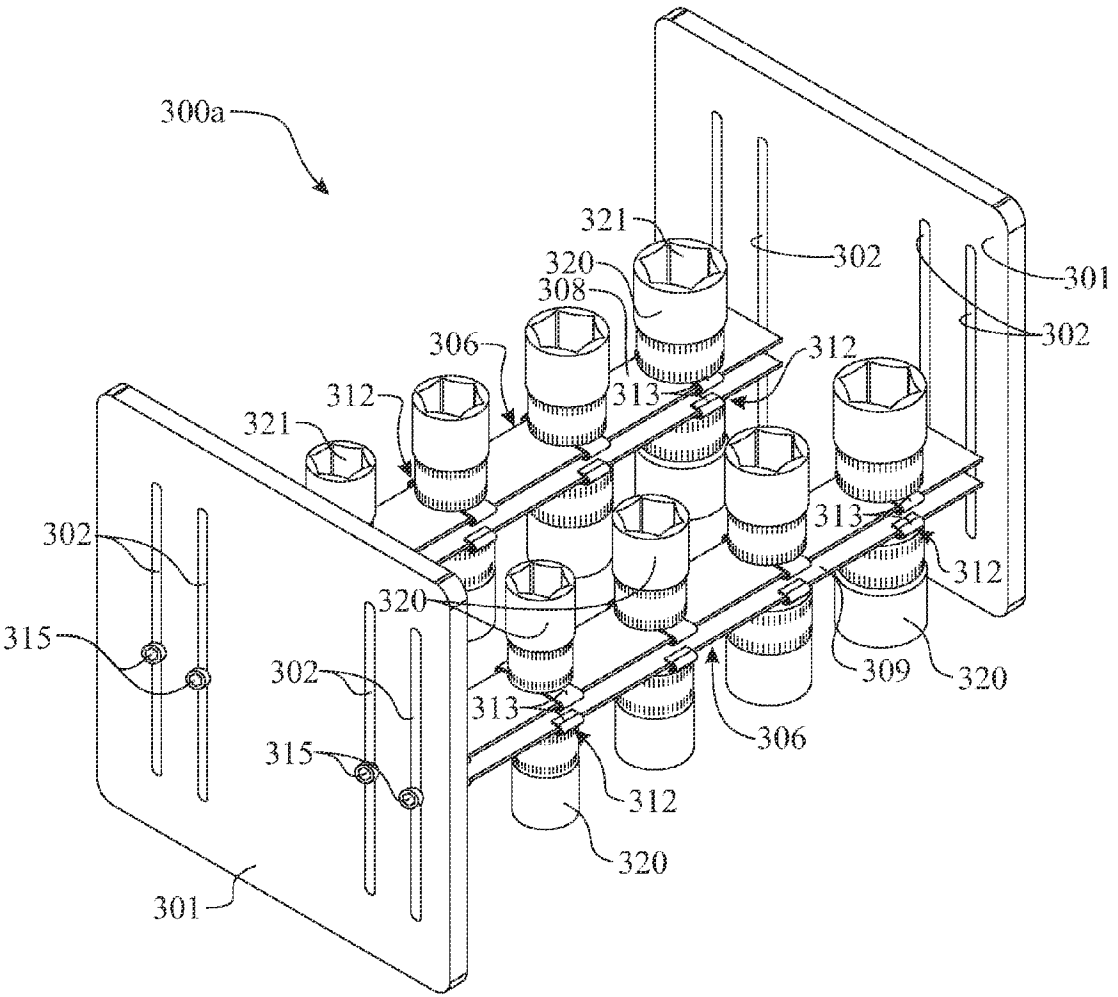
FIG. 5 is a perspective view of the illustrative embodiment of the socket storage apparatus illustrated in FIG. 3, more particularly illustrating alternative positioning of a pair of socket support platforms of the apparatus.
Figure 6:
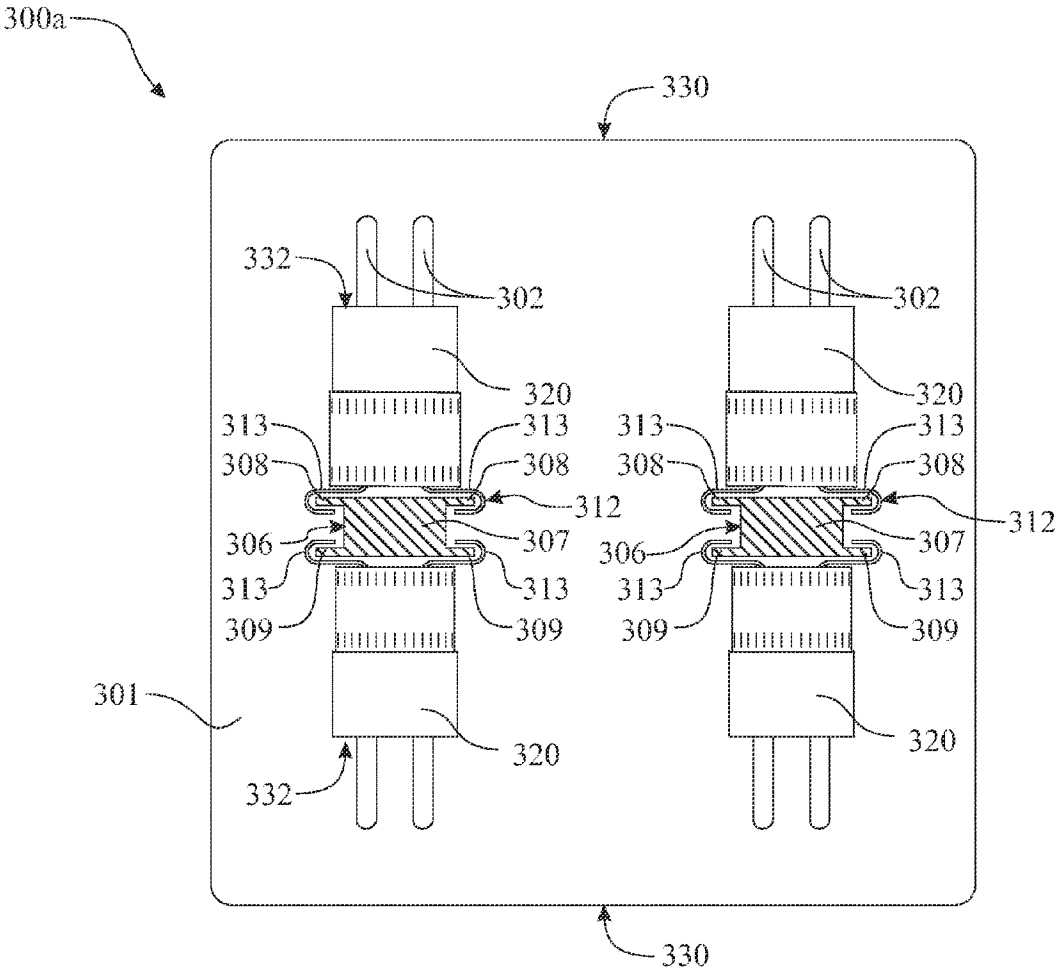
FIG. 6 is a cross-sectional view of the socket storage apparatus illustrated in FIG. 5.

As illustrated in FIGS. 3-6, in some embodiments of the socket storage apparatus 300*a*, both socket support platforms 306 may be vertically adjustably mounted between the base panels 301 such as in the manner which was heretofore described with respect to FIGS. 1 and 2, for example. In FIGS. 3 and 4, the socket support platforms 306 of the socket storage apparatus 300*a* are shown at different vertical positions. In FIGS. 5 and 6, the socket support platforms 306 are shown at the same vertical position.

Figure 8:
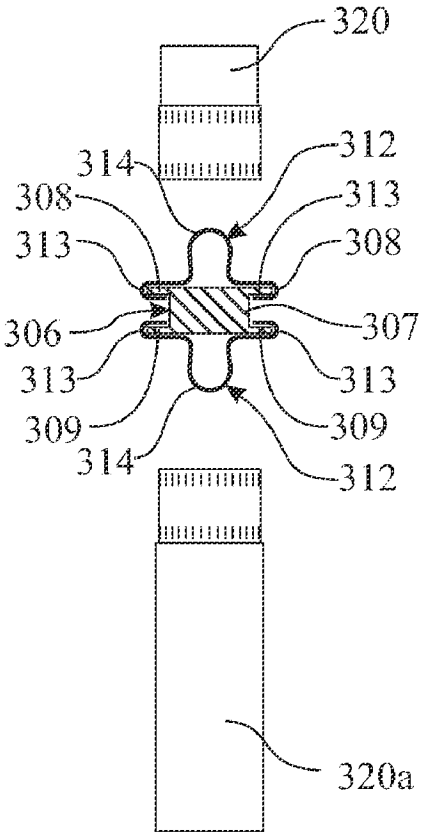
FIG. 8 is a cross-sectional view of the socket support platform, with a pair of sockets positioned for attachment to the socket support platform.
Figure 7:
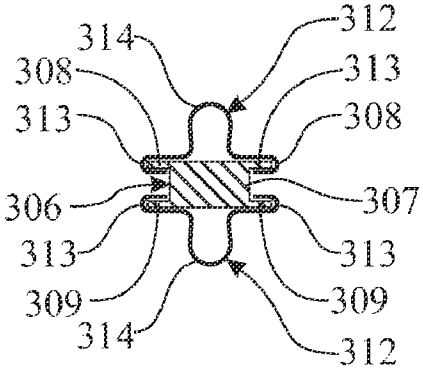
FIG. 7 is a cross-sectional view of a socket support platform of each of the socket storage apparatuses illustrated in FIGS. 1-6.
Figure 10:
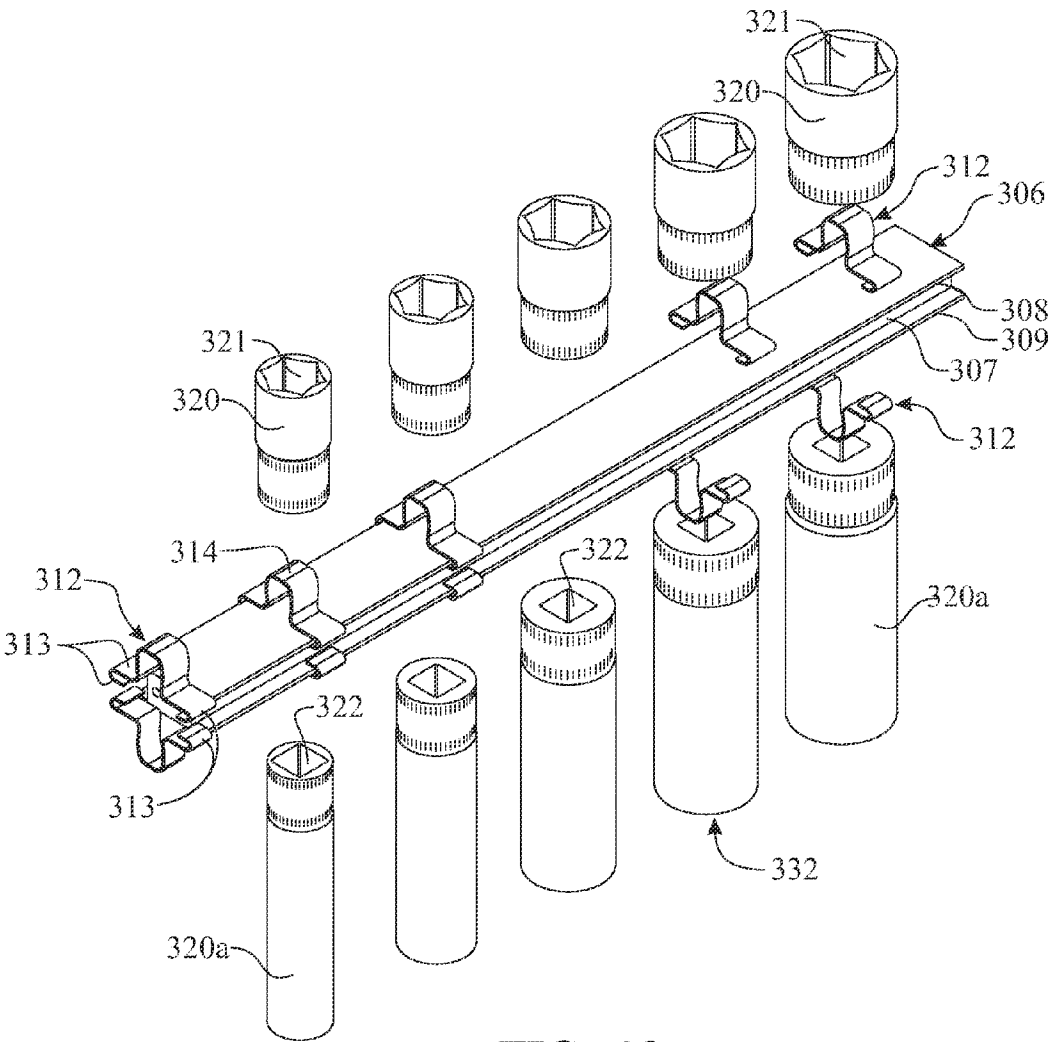
FIG. 10 is an exploded perspective view of the socket support platform, more particularly illustrating an exemplary bracket technique for attaching multiple sockets to the socket support platform.
Figure 11:
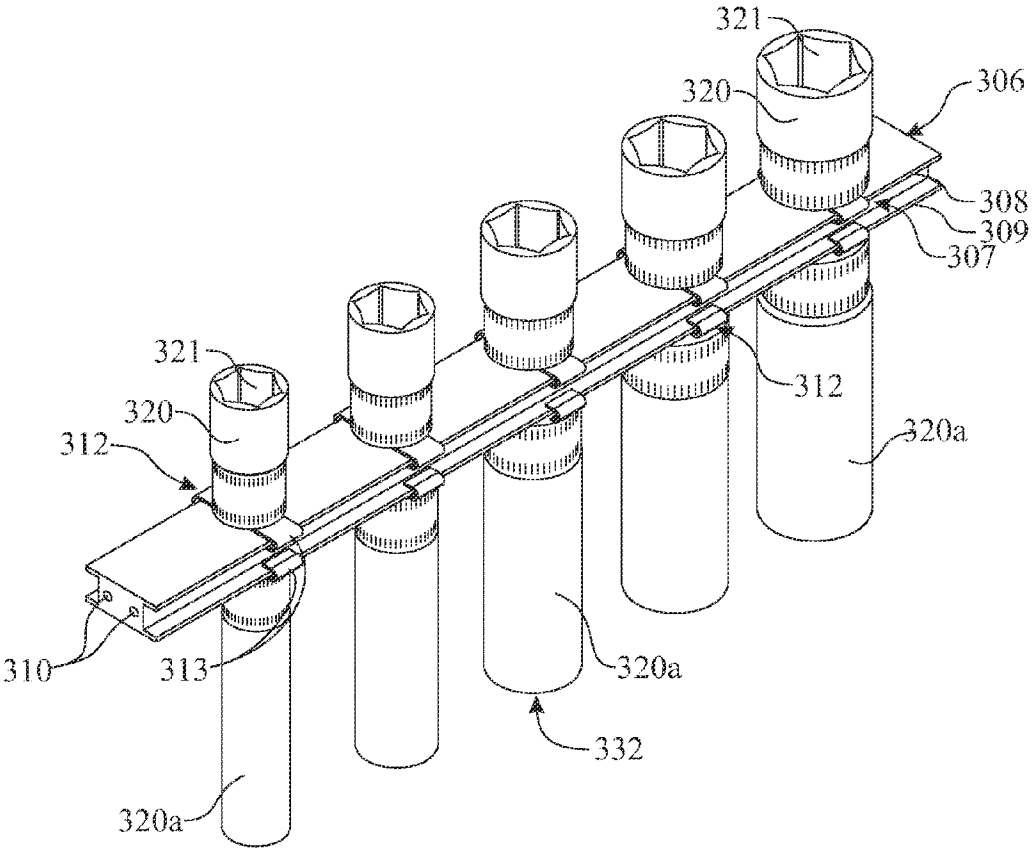
FIG. 11 is a perspective view of the socket support platform illustrated in FIG. 10, with the sockets attached to the socket support platform.

As illustrated in FIGS. 2, 4 and 6, each socket support platform 306 of the socket storage apparatus 300 and the socket storage apparatus 300*a* includes a generally elongated platform body 307 which may have a rectangular cross-section. A pair of top platform flanges 308 and a pair of bottom platform flanges 309 extends from opposite sides of the platform body 307. As illustrated in FIGS. 7, 8 and 10, multiple socket support brackets 312 are provided on each socket support platform 306. Any desired number of socket support brackets 312 may be provided along the top and/or bottom of each socket support platform 306 in any desired spacing with respect to each other. As illustrated in FIG. 7, each socket support bracket 312 may include bracket flanges 313, which extend from opposite ends of a generally curved or looped bracket body 314. The bracket flanges 313 of each socket support bracket 312 engage the top platform flanges 308 or the bottom platform flanges 309 of the socket support platform 306, as further illustrated in FIG. 7.

In typical application, the socket storage apparatus 300 and the socket storage apparatus 300*a* are used to organize and store multiple socket wrench sockets 320, which are used in conjunction with a socket wrench (not illustrated) to tighten and/or loosen a bolt (not illustrated) or nut (not illustrated) in any of a variety of applications. The sockets 320 may be conventional and have various sizes. A socket opening 321, which is sized and configured to receive and engage a bolt or nut (not illustrated) having a corresponding size, is provided in a first end of each socket 320. The socket opening 321 may have a hexagonal-shaped interior surface, as shown, or may alternatively have a multi-notched or toothed interior engaging surface (not illustrated), as is known by those skilled in the art. As illustrated in FIG. 10, a socket wrench opening 322, which may have a generally square shape, is provided in a second end of each socket 320. The socket wrench opening 322 is adapted to receive a male connector (not illustrated) provided on a ratchet mechanism of the socket wrench (not illustrated), as is known by those skilled in the art, to facilitate rotation of the socket 320 and tightening and/or loosening of the bolt or nut by operation of the socket wrench typically in the conventional manner.

Figure 9:
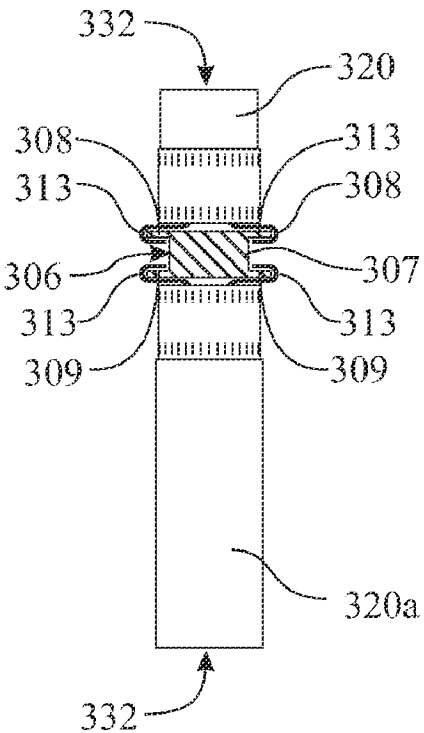
FIG. 9 is a cross-sectional view of the socket support platform, with a pair of sockets attached to the socket support platform.

The sockets 320 may be attached to a socket support platform 306 of the socket storage apparatus 300, 300*a* in order of increasing or decreasing size of the socket openings 321 of the sockets 320. As illustrated in FIGS. 8-10, each socket 320 may be attached to the socket support platform 306 by inserting the curved or looped bracket body 314 of each socket support bracket 312 into the socket wrench opening 322 of each corresponding socket 320. Accordingly, the bracket body 314 of each socket support bracket 312 is friction-fitted into the socket wrench opening 322 of each corresponding socket 320 to detachably secure the socket 320 to the socket support platform 306. Each socket 320 can be selectively accessed for use by grasping and pulling of the socket 320 from the bracket body 314 of the corresponding socket support bracket 312 and insertion of the male connector (not illustrated) on the ratchet mechanism of the socket wrench (not illustrated) into the socket wrench opening 322 of the socket 320, after which the socket wrench may be used to tighten and/or loosen a bolt or nut in the conventional manner by reception and engagement of the socket opening 321 with the bolt or nut. After use of the socket wrench, the socket 320 may be removed from the male connector of the ratchet mechanism and replaced on the appropriate socket support bracket 312. It will be appreciated by those skilled in the art that spacing of the sockets 320 in an organized manner along each socket support platform 306 of the socket storage apparatus 300, 300*a* renders the sockets 320 accessible to a user in confined spaces.

Figures 12A, 12B, 12C, 12D, 12E:
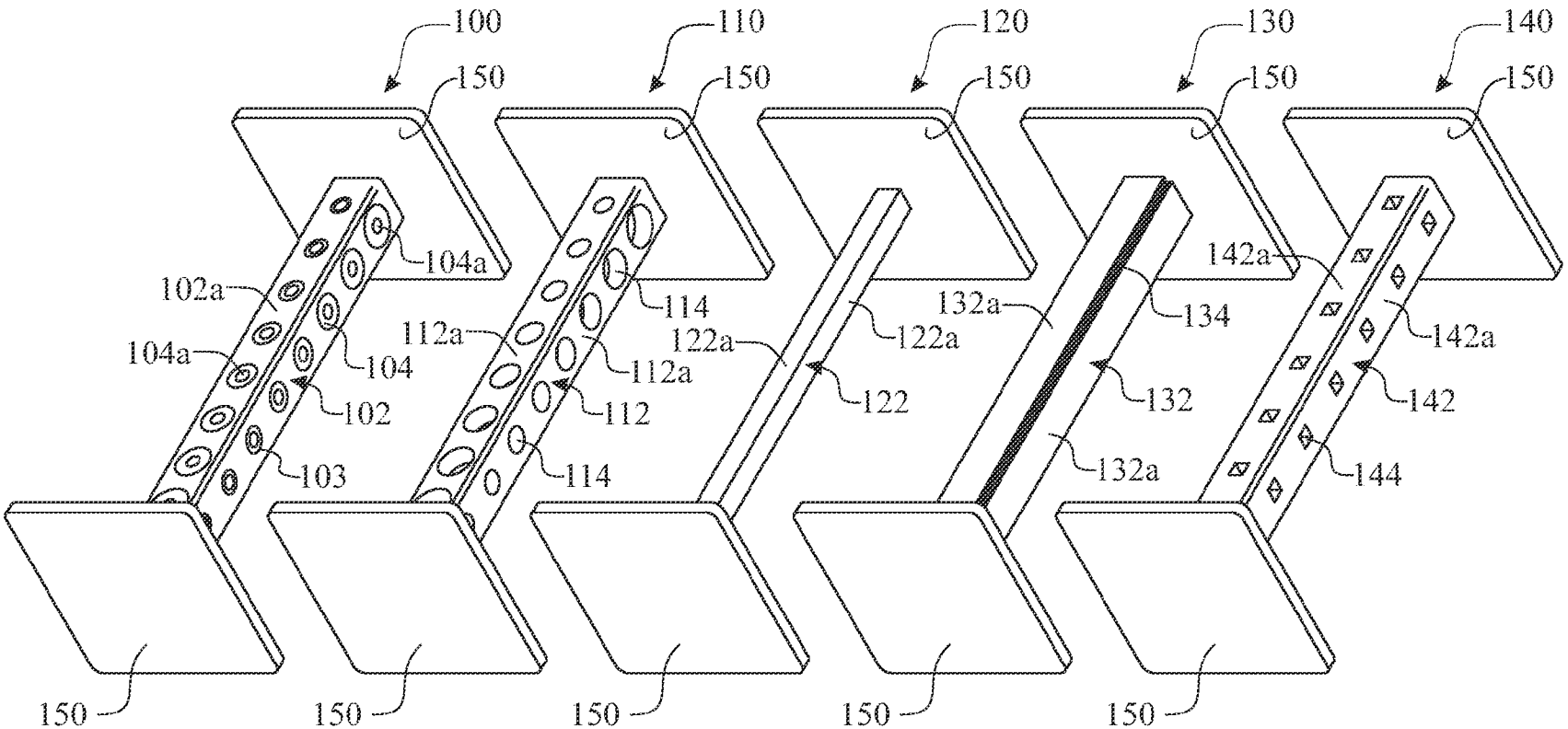
FIG. 12A is a perspective view of an alternative illustrative embodiment of the socket storage apparatus.
FIG. 12B is a perspective view of another alternative illustrative embodiment of the socket storage apparatus.
FIG. 12C is a perspective view of still another alternative illustrative embodiment of the socket storage apparatus.
FIG. 12D is a perspective view of yet another alternative illustrative embodiment of the socket storage apparatus.
FIG. 12E is a perspective view of still another alternative illustrative embodiment of the socket storage apparatus.
Figure 30:
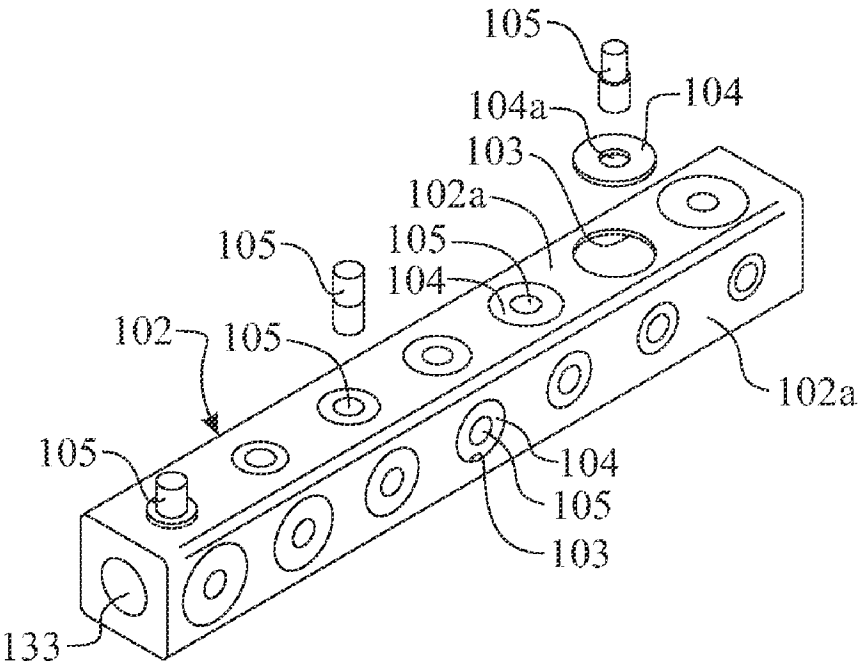
FIG. 30 is an exploded perspective view of a socket support member of the socket storage apparatus illustrated in FIG. 12A, illustrating seating of multiple socket grommets in multiple grommet openings provided in the socket support member and insertion of multiple sockets in the socket grommets.

Referring next to FIGS. 12A and 30 of the drawings, an alternative illustrative embodiment of the socket storage apparatus is generally indicated by reference numeral 100 in FIG. 12A. The socket storage apparatus 100 includes a pair of generally parallel, spaced-apart base panels 150. A generally elongated socket support member 102 extends between and is attached to the base panels 150 according to the knowledge of those skilled in the art. In some embodiments, the socket support member 102 may have a generally square or rectangular cross-section with four support member surfaces 102*a* disposed in generally perpendicular relationship with respect to each other. However, the socket support member 102 may have any desired number of support member surfaces 102*a*.

Multiple grommet openings 103 are provided in each support member surface 102*a* of the socket support member 102. As illustrated in FIG. 30, each grommet opening 103 is adapted to receive a resilient rubber or plastic socket grommet 104. Each socket grommet 104 has a socket opening 104*a*. The socket openings 104*a* of the socket grommets 104 may have various sizes and may each be adapted to receive a socket wrench socket 105 having a particular size. Accordingly, in typical application of the socket storage apparatus 100, one of the base panels 150 may be placed on a flat support surface (not illustrated) with the socket support member 102 oriented vertically. Alternatively, both of the base panels 150 may be placed edgewise on the support surface with the socket support member 102 oriented horizontally. The socket wrench sockets 105 (FIG. 30) are inserted in the socket openings 104*a* of the respective socket grommets 104 typically according to increasing or decreasing size of the sockets 105 along each support member surface 102*a* of the socket support member 102. Each socket 105 can be selectively accessed for use by grasping and pulling of the socket 105 from the socket opening 104*a* of the corresponding socket grommet 104 and insertion of the male connector (not illustrated) on the ratchet mechanism of the socket wrench (not illustrated) into the socket wrench opening (not illustrated) of the socket 105, after which the socket wrench may be used to tighten and/or loosen a bolt or nut in the conventional manner. After use of the socket wrench, the socket 105 may be removed from the male connector of the ratchet mechanism and replaced in the socket opening 104*a* of the appropriate socket grommet 104. It will be appreciated by those skilled in the art that spacing of the sockets 105 in an organized manner in the socket grommets 104 along a support member surface 102*a* of the socket support member 102 renders the sockets 105 accessible to a user in confined spaces.

Figure 29:
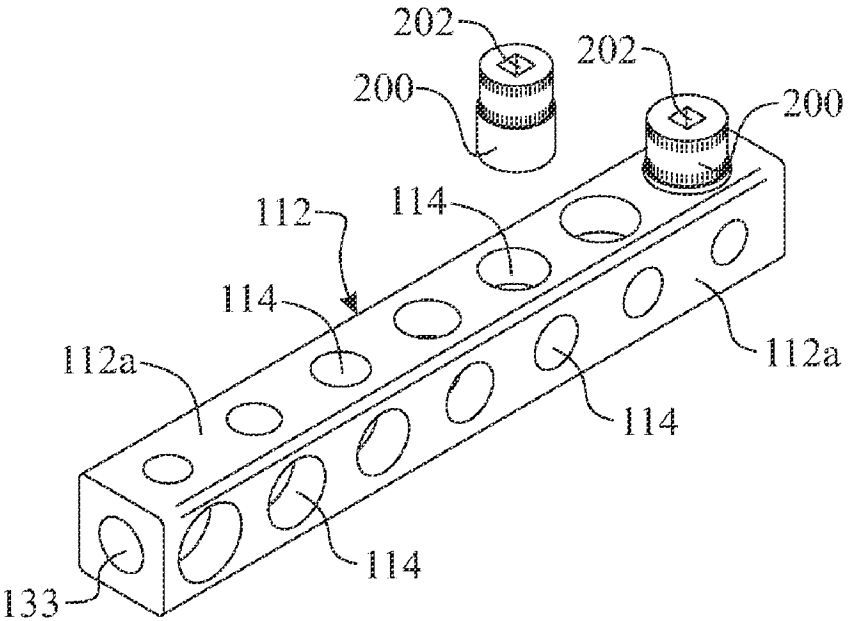
FIG. 29 is an exploded perspective view of a socket support member of the socket storage apparatus illustrated in FIG. 12B, with one socket attached to the socket support member and another socket detached from the socket support member.

Referring next to FIGS. 12B and 29 of the drawings, another alternative illustrative embodiment of the socket storage apparatus is generally indicated by reference numeral 110 in FIG. 12B. The socket storage apparatus 110 includes a pair of generally parallel, spaced-apart base panels 150. A generally elongated socket support member 112 extends between and is attached to the base panels 150 according to the knowledge of those skilled in the art. In some embodiments, the socket support member 112 may have a generally square or rectangular cross-section with four support member surfaces 112*a* disposed in generally perpendicular relationship with respect to each other, although in other embodiments the socket support member 112 may have a different number of support member surfaces 112*a*.

Multiple socket openings 114 which may have various sizes are provided in each support member surface 112*a* of the socket support member 112. As illustrated in FIG. 29, each socket opening 114 is adapted to receive a socket 200 having a socket opening 201 (FIG. 15) and a socket wrench opening 202 (FIG. 29). The edge of each socket opening 114 may be magnetized to secure the socket 200 in the socket opening 114. Other techniques, which are known by those skilled in the art, may be used to detachably secure each socket 200 in the corresponding socket opening 114. The socket openings 114 may have various sizes and may each be adapted to receive a socket wrench socket 200 with a socket opening 201 having a particular size. Accordingly, in typical application of the socket storage apparatus 100, one of the base panels 150 may be placed on a flat support surface (not illustrated) with the socket support member 102 oriented vertically or the base panels 150 may be placed edgewise on the support surface with the socket support member 102 oriented horizontally. The socket wrench sockets 200 (FIG. 29) are inserted in the respective socket openings 114 typically according to increasing or decreasing size along each support member surface 112*a* of the socket support member 112. Each socket 200 can be selectively accessed for use by grasping and pulling of the socket 200 from the socket opening 114 and insertion of the male connector (not illustrated) on the ratchet mechanism of the socket wrench (not illustrated) into the socket wrench opening (not illustrated) of the socket 105, after which the socket wrench may be used to tighten and/or loosen a bolt or nut in the conventional manner. After use of the socket wrench, the socket 114 may be removed from the male connector of the ratchet mechanism and replaced in the appropriate socket opening 114. It will be appreciated by those skilled in the art that spacing of the sockets 200 in an organized manner in the socket openings 114 along a support member surface 112*a* of the socket support member 112 renders the sockets 200 accessible to a user in confined spaces.

Referring next to FIGS. 12C and 24-28 of the drawings, still another alternative illustrative embodiment of the socket storage apparatus is generally indicated by reference numeral 120 in FIG. 12C. The socket storage apparatus 120 includes a pair of generally parallel, spaced-apart base panels 150. A generally elongated socket support member 122 extends between and is attached to the base panels 150 according to the knowledge of those skilled in the art. In some embodiments, the socket support member 122 may have a generally square or rectangular cross-section and may have four or an alternative number of support member surfaces 122*a*.

Figure 25:
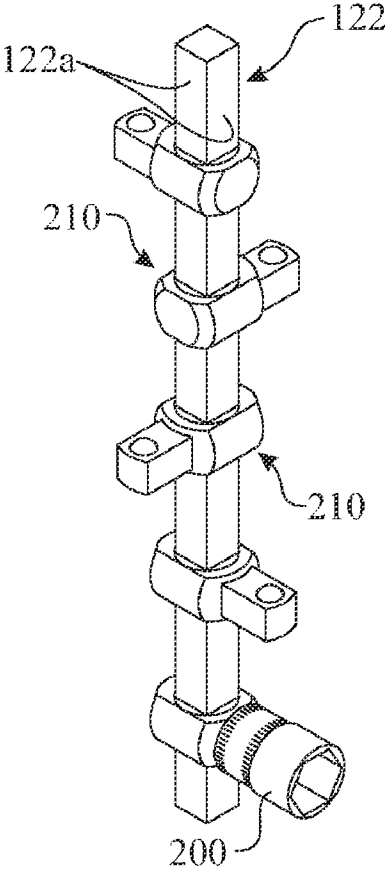
FIG. 25 is a perspective view of the socket support member illustrated in FIG. 24, with the sockets provided on the socket support member.
Figure 24:
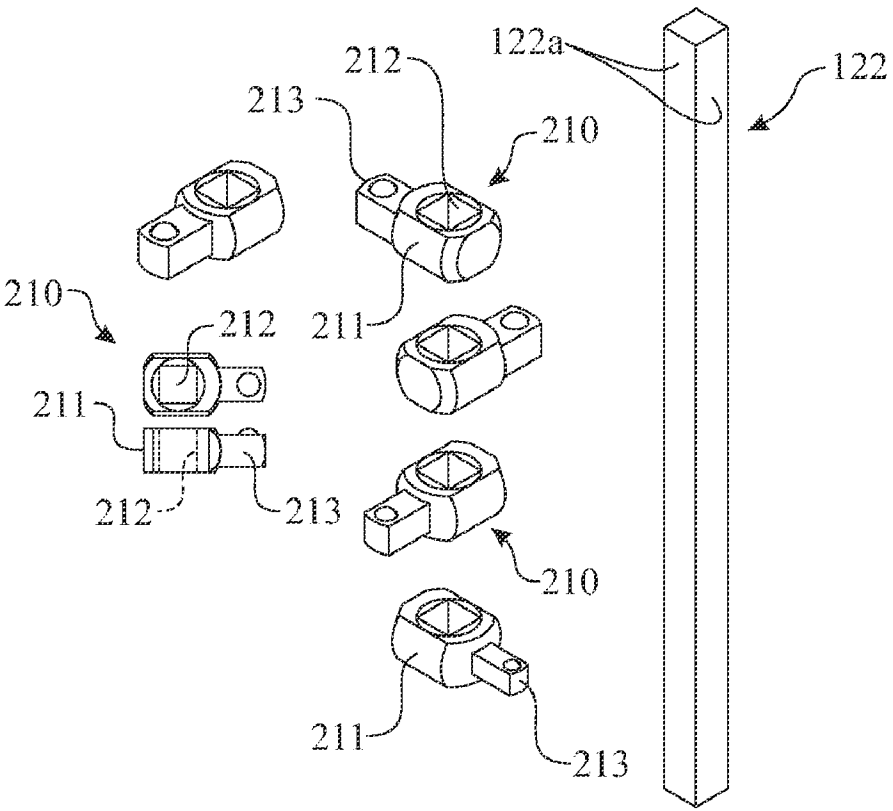
FIG. 24 is an exploded perspective view of a socket support member of the socket storage apparatus illustrated in FIG. 12C, preparatory to attachment of multiple sockets to the socket support member.

As illustrated in FIGS. 24 and 25, in one application the socket support member 122 of the socket storage apparatus 120 is adapted to support multiple socket wrench sockets 210 of the type having a socket head 211 and a generally square or rectangular socket opening 212 extending through the socket head 211. A male socket connector 213 extends from the socket head 211 for attachment to a ratchet mechanism on a socket wrench (not illustrated). Multiple ones of the sockets 210 may be placed on the socket support member 122 by extending the socket support member 122 through the socket openings 212 of the sockets 210, as illustrated in FIG. 25. The sockets 210 may be arranged on the socket support member 122 in order of increasing or decreasing size of the socket openings 212 of the respective sockets 210, for example. The ends of the socket support member 122 can then be re-attached to the respective base panels 150 according to the knowledge of those skilled in the art. Each socket 210 can be individually selectively accessed for use by removing one of the base panels 150 from a corresponding end of the socket support member 122, grasping and pulling of the socket 210 from the socket support member 122 and attachment of the socket connector 213 to the ratchet mechanism of the socket wrench (not illustrated), after which the socket wrench may be used to tighten and/or loosen a bolt or nut in the conventional manner. After use of the socket wrench, the socket 210 may be removed from the ratchet mechanism and replaced on the socket support member 122. One or both of the base panels 150 may be replaced on one or both ends of the socket support member 122. It will be appreciated by those skilled in the art that spacing of the sockets 210 in an organized manner on the socket support member 122 of the socket storage apparatus 120 accessible to a user in confined spaces.

Figure 27:
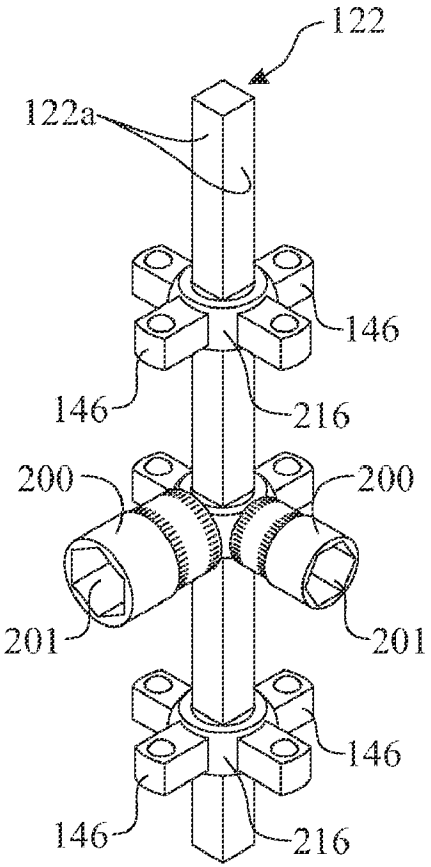
FIG. 27 is a perspective view of the socket support member illustrated in FIG. 26, with multiple adaptor holders with attached adaptors placed on the socket support member and a pair of sockets attached to a pair of the adaptors.
Figure 26:
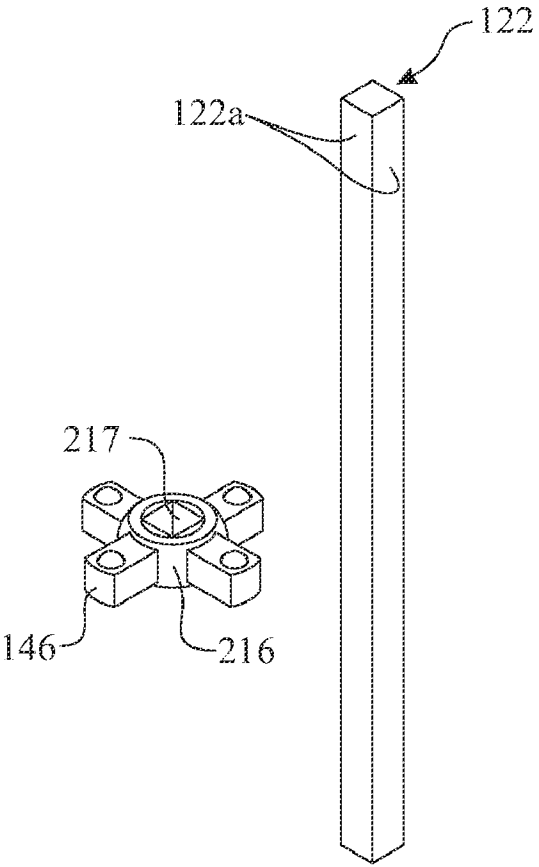
FIG. 26 is an exploded perspective view of the socket support member illustrated in FIG. 24, preparatory to placement of an adaptor holder with multiple attached adaptors on the socket support member.
Figure 28:
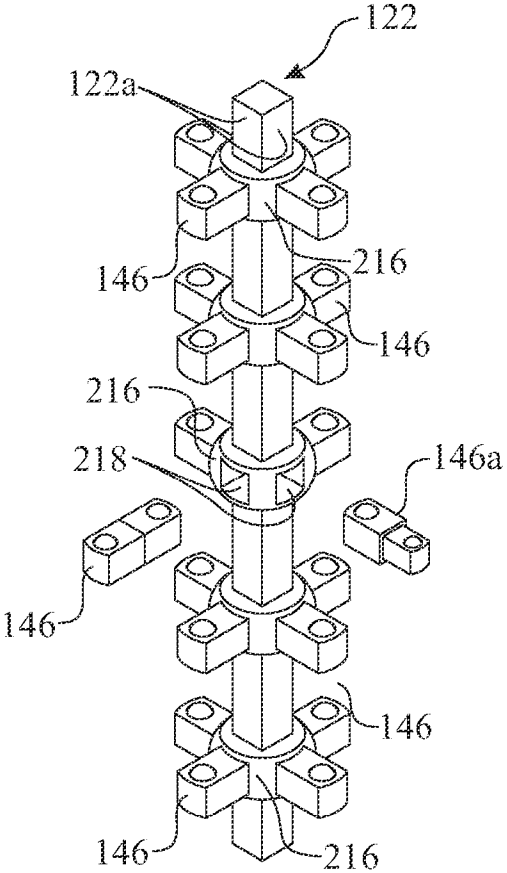
FIG. 28 is an exploded perspective view of the socket support member illustrated in FIG. 26, with multiple adaptor holders with attached adaptors placed on the socket support member and a straight adaptor and a stepped adaptor detached from an adaptor holder.

As illustrated in FIGS. 26-28, in another application the socket support member 122 of the socket storage apparatus 120 is adapted to support multiple adaptor holders 216 each having a central adaptor holder opening 217. The socket support member 122 is extended through the adaptor holder openings 217 of the respective adaptor holders 216 to mount a selected number of the adaptor holders 216 on the socket support member 122. As illustrated in FIG. 28, multiple adaptor openings 218 may be provided in each adaptor holder 216. The adaptor openings 218 may be suitable for receiving an adaptor such as a straight adaptor 146 or a stepped adaptor 146*a*, for example. As illustrated in FIG. 27, a socket 200 can be supported on each straight adaptor 146 or stepped adaptor 146*a*, which is inserted in an adaptor opening 218 of the adaptor holder 216. This may be accomplished by inserting the extending portion of each straight adaptor 146 or stepped adaptor 146*a* into the socket wrench opening 202 (FIG. 13) of each socket 200. The sockets 200 may be arranged on the adaptor holders 216 and along the socket support member 122 according to increasing or decreasing size of the socket openings 212 of the respective sockets 200, for example. After placement of the adaptor holders 216 on the socket support member 122, the socket support member 122 may be placed between the base panels 150 (FIG. 12C) of the socket storage apparatus 120 and one or both of the base panels 150 supported on a supporting surface (not illustrated). Each socket 200 can be individually selectively accessed for use on the ratchet mechanism of the socket wrench by pulling the socket 200 from the corresponding straight adaptor 146 or stepped adaptor 146*a*, which extends from an adaptor holder 216. After use of the socket wrench, the socket 200 may be removed from the ratchet mechanism and replaced on the straight adaptor 146 or stepped adaptor 146*a* on one of the adaptor holders 216.

Referring next to FIGS. 12D and 13-20 of the drawings, another alternative illustrative embodiment of the socket storage apparatus is generally indicated by reference numeral 130 in FIG. 12D. The socket storage apparatus 130 includes a pair of generally parallel, spaced-apart base panels 150. A generally elongated socket support member 132 extends between and is attached to the base panels 150 according to the knowledge of those skilled in the art. In some embodiments, the socket support member 132 may have a generally square or rectangular cross-section with multiple support member surfaces 132*a* disposed in generally perpendicular relationship with respect to each other or may have any other desired number of support member surfaces 132*a*.

Figure 13:
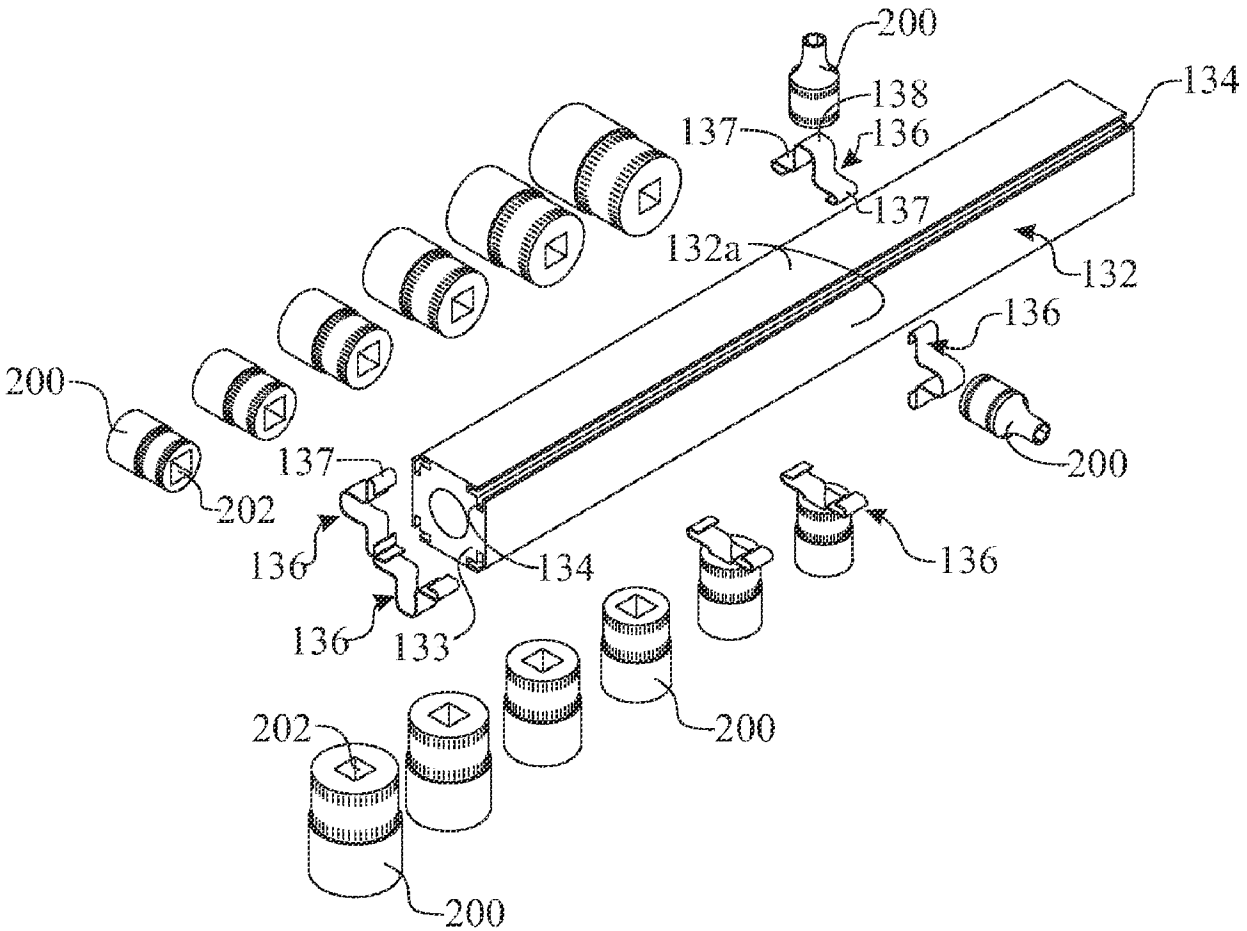
FIG. 13 is an exploded perspective view illustrating an exemplary bracket technique for attaching multiple sockets to a socket support member of the socket storage apparatus illustrated in FIG. 12D.
Figure 14:
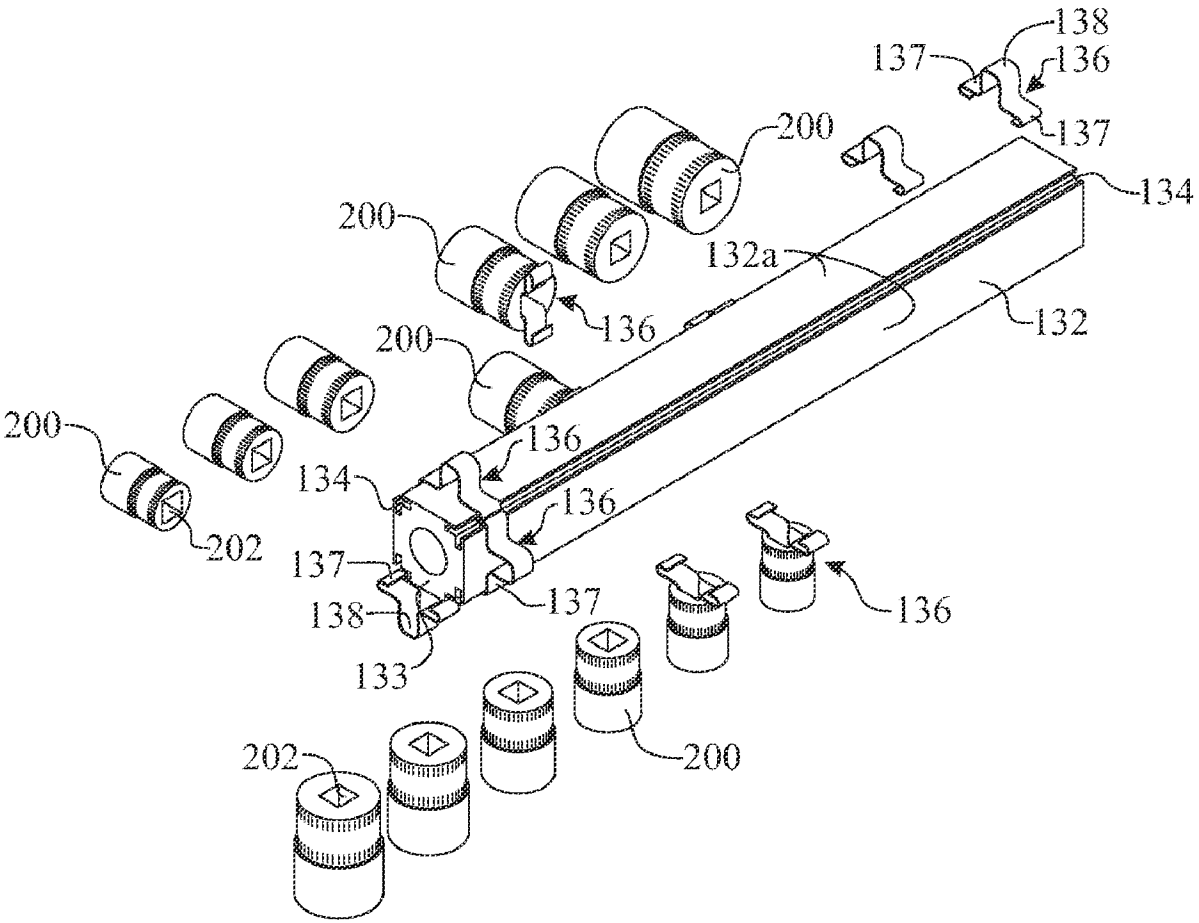
FIG. 14 is an exploded perspective view of the socket support member illustrated in FIG. 13, with multiple socket support brackets provided on the socket support member preparatory to attachment of the sockets to the socket support brackets.

Multiple elongated bracket slots 134 are provided in the socket support member 132. Each bracket slot 134 may be provided at the junction between each support member surface 132*a* with the adjacent support member surface 132*a*. As illustrated in FIG. 13, an insert opening 133 may be provided in each end of the socket support member 132 for purposes, which will be hereinafter described.

Figure 15:
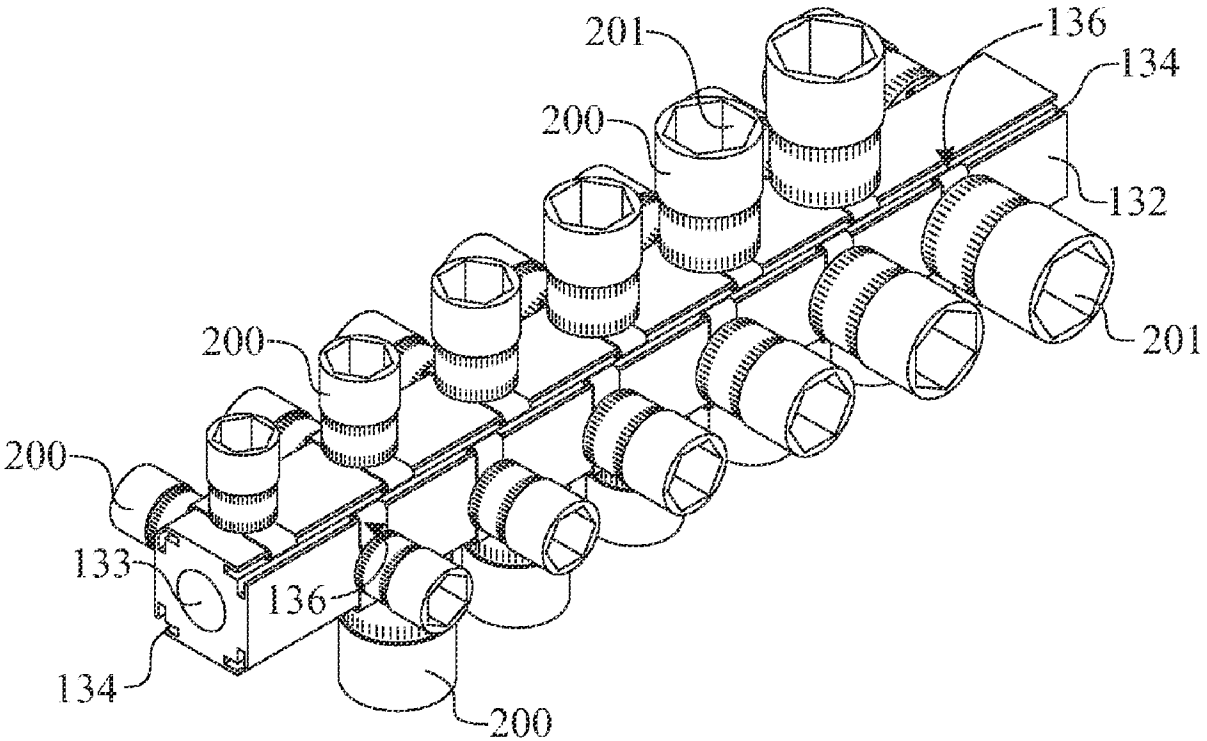
FIG. 15 is a perspective view of the socket support member illustrated in FIGS. 13 and 14, with the sockets attached to the socket support brackets.
Figure 16:
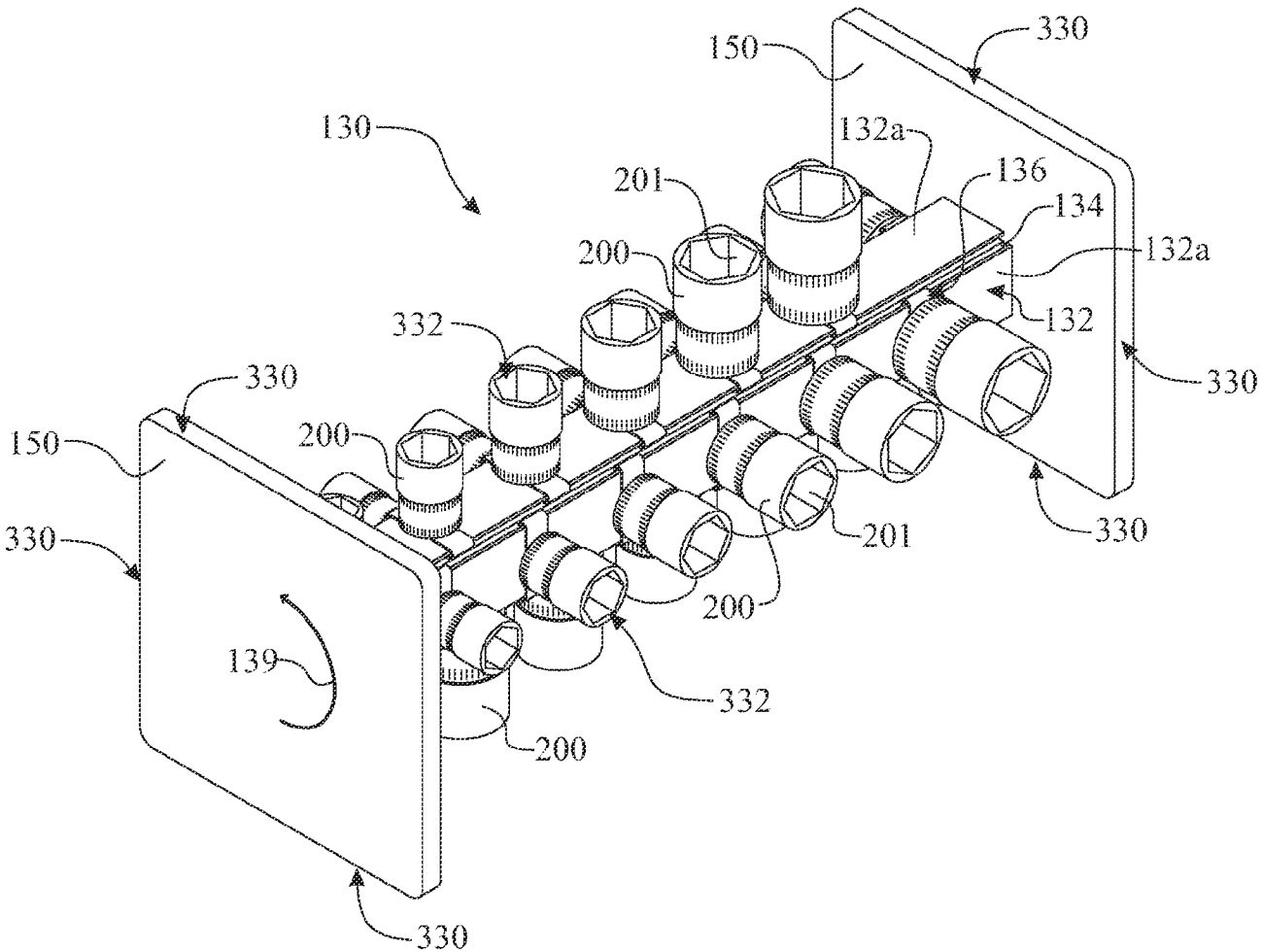
FIG. 16 is a perspective view of the socket storage apparatus illustrated in FIG. 12D, with multiple sockets attached to the socket support member of the socket storage apparatus.
Figure 17:
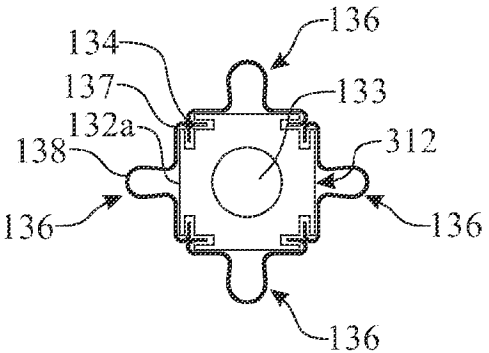
FIG. 17 is an end view of the socket support member of the socket storage apparatus illustrated in FIG. 16, with multiple socket support brackets provided on the socket support member.
Figure 19:
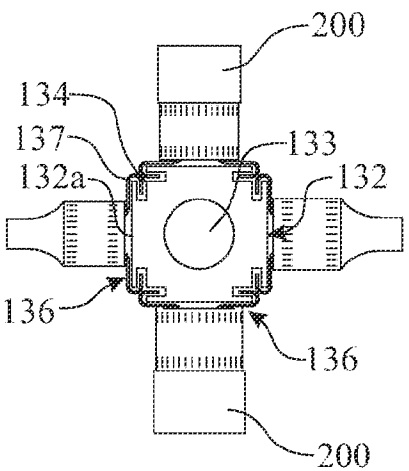
FIG. 19 is an end view of the socket support member of the socket storage apparatus illustrated in FIG. 16, with the sockets attached to the respective socket support brackets on the socket support member.
Figure 18:
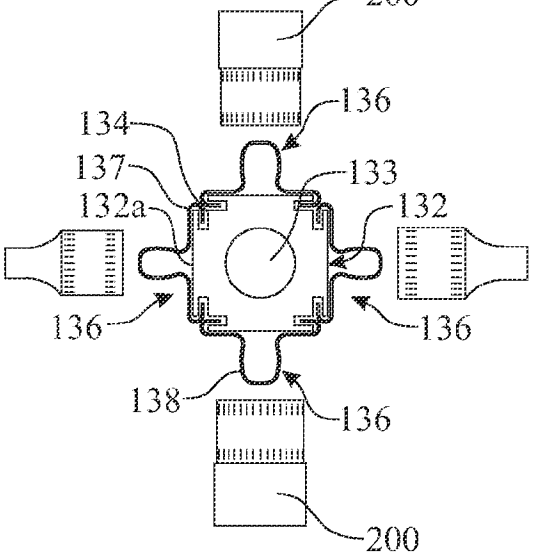
FIG. 18 is an end view of the socket support member of the socket storage apparatus illustrated in FIG. 16, preparatory to attachment of multiple sockets to the respective socket support brackets provided on the socket support member.
Figure 20:
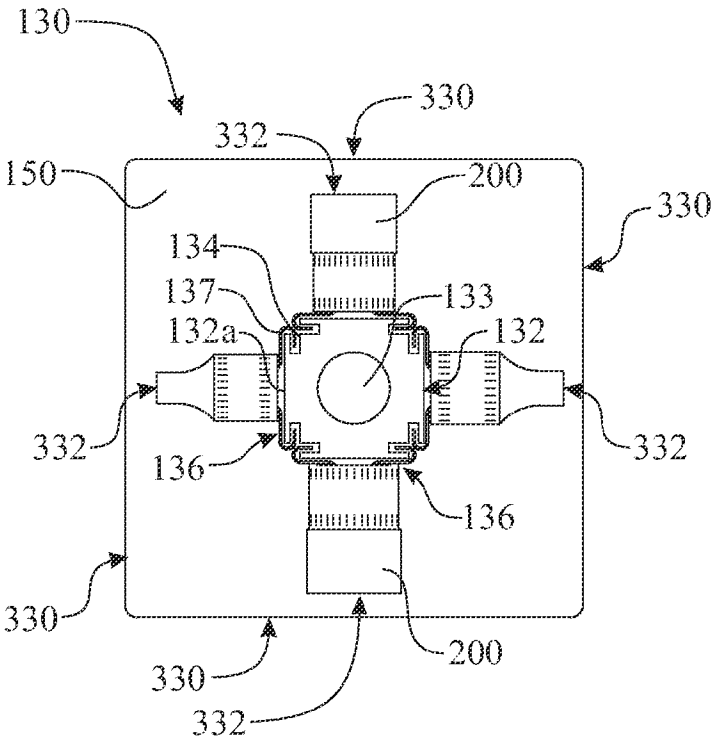
FIG. 20 is a cross-sectional view of the socket storage apparatus illustrated in FIG. 16, with the sockets attached to the respective socket support brackets on the socket support member of the apparatus.

As illustrated in FIGS. 13-20, each of multiple socket support brackets 136 engages an adjacent pair of the bracket slots 134 in the socket support member 132. As illustrated in FIGS. 13, 14 and 17-19, each socket support bracket 136 includes a pair of spaced-apart bracket flanges 137 which extend from a central curved or looped bracket body 138. As illustrated in FIGS. 17-19, the bracket flanges 137 of each socket support bracket 136 are inserted in the respective adjacent bracket slots 134, with the looped bracket body 138 spanning a corresponding support member surface 132*a* of the socket support member 132, to attach each socket support bracket 136 to the socket support member 132. Any desired number of the socket support brackets 136 can be provided along each support member surface 132*a* of the socket support member 132 to facilitate attachment of any number of sockets 200 to the socket support member 132. Accordingly, the socket wrench opening 202 (FIG. 13) of each socket 200 receives the curved or looped bracket body 138 of the socket support bracket 136 to attach each socket 200 to the socket support bracket 136 in a friction fit. As illustrated in FIG. 15, multiple sockets 200 can be arranged along each support member surface 132*a* of the socket support member 132 according to increasing or decreasing size of the socket openings 201 of the respective sockets 200, for example. As illustrated in FIG. 16, the ends of the socket support member 132 can be attached to the respective base panels 150 according to the knowledge of those skilled in the art. In application of the socket storage apparatus 130, both of the base panels 150 can rest edgewise on a supporting surface (not illustrated) with the socket support member 132 disposed in a horizontal position, as illustrated in FIG. 16, or one of the base panels 150 can rest on the supporting surface with the socket support member 132 disposed in a vertical position, to render the sockets 200 identifiable and accessible to a user in confined spaces, for example. Each socket 200 can be individually removed from the corresponding socket support bracket 136 for use and returned to the socket support bracket 136 after use. As indicated by the arrow 139 in FIG. 16, the socket support member 132 may be rotatably mounted between the base panels 150 to aid in identification and selection of the desired socket 200. Although a shallow or standard socket 320 is illustrated, it is understood that a deep socket 320*a* can be applied to at least two of the four sides of the socket support member 132.

Figure 23:
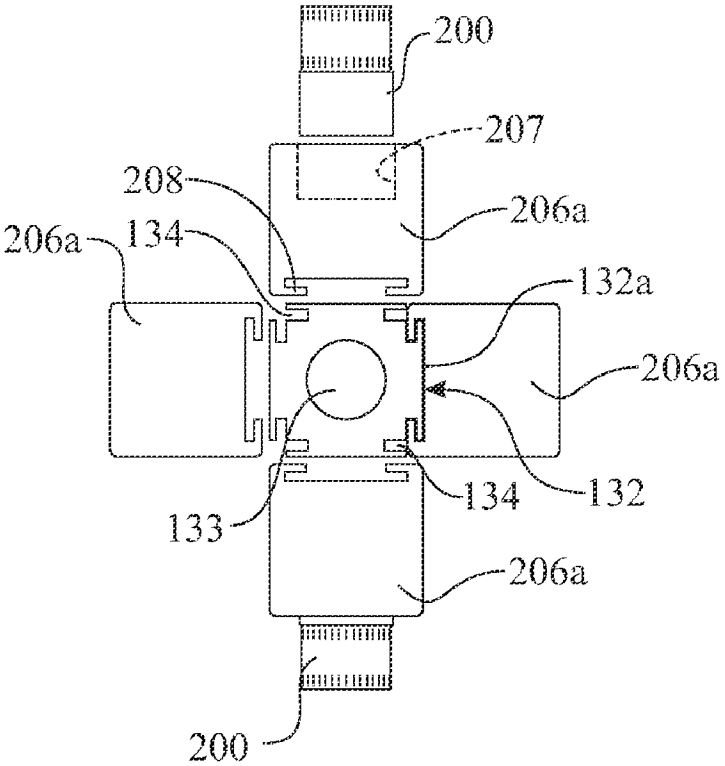
FIG. 23 is an end view of the socket support member illustrated in FIG. 21, illustrating alternative flanged attachment of each connector block to the socket support member.

Referring next to FIG. 23 of the drawings, in another application of the socket storage apparatus 130, at least one connector block 206*a* includes a pair of spaced-apart slot engaging flanges 208 which are inserted in respective bracket slots 134 provided in the socket support member 132 and a socket cavity 207 which receives a socket 200. Multiple, adjacent connector blocks 206*a* may engage the bracket slots 134 along the length of the socket support member 132, in which case the sockets 200 inserted in the socket cavities 207 of the respective connector blocks 206*a* may be arranged according to increasing or decreasing sizes of the socket openings 201 (FIG. 15) in the respective sockets 200. Accordingly, each socket 200 is accessed when needed by removal from the socket cavity 207 of the corresponding connector block 206 and may be returned to the socket cavity 209 after use.

Figure 32:
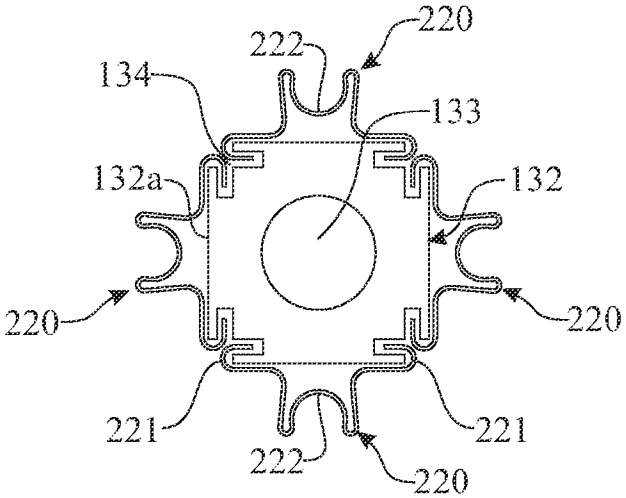
FIG. 32 is an end view of the socket support member illustrated in FIG. 13, with multiple socket tool clips provided on the socket support member.
Figure 31:
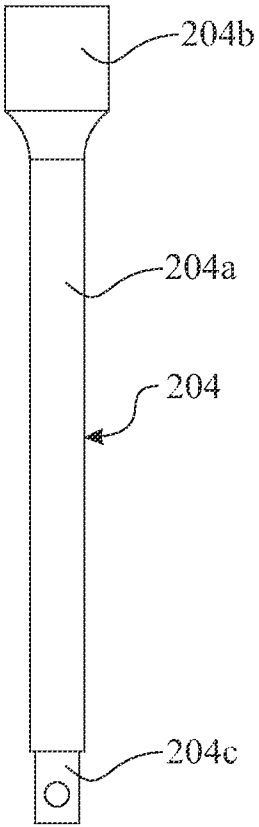
FIG. 31 is a side view of an elongated socket tool.
Figure 33:
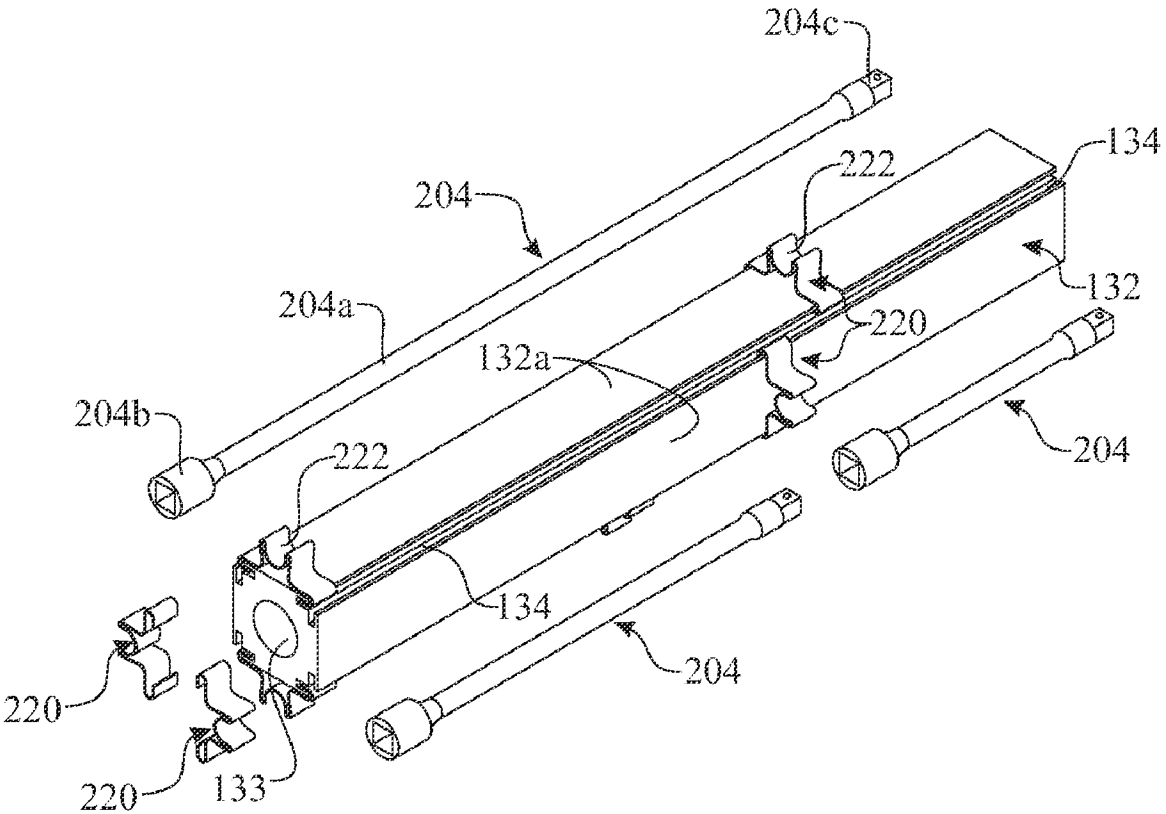
FIG. 33 is an exploded perspective view of the socket support member illustrated in FIG. 32, preparatory to attachment of multiple elongated socket tools to the socket tool clips on the socket support member.
Figure 34:
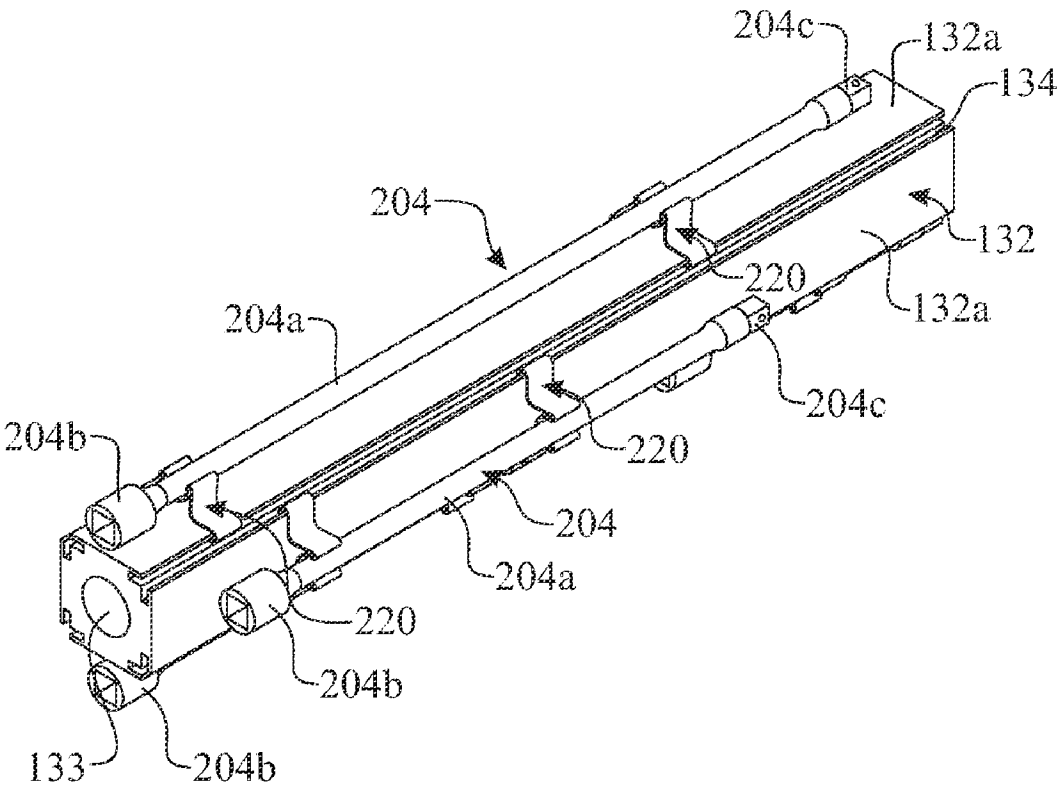
FIG. 34 is a perspective view of the socket support member illustrated in FIG. 32, with the elongated socket tools attached to the respective socket tool clips on the socket support member.

Referring next to FIGS. 31-34 of the drawings, in another application of the socket storage apparatus 130, at least one socket tool clip 220 can be attached to a pair of adjacent bracket slots 134 in the socket support member 132. As illustrated in FIG. 32, each socket tool clip 220 may include a pair of spaced-apart clip flanges 221 which are inserted in the respective bracket slots 134 and a generally cradle-shaped or concave clip cradle 222, which extends between the clip flanges 221. As illustrated in FIGS. 33 and 34, the tool shaft 204*a* of an elongated socket tool 204 can be inserted in the clip cradle 222 of each socket tool clip 220 to attach the elongated socket tool 204 to the socket support member 132. A socket 204*b* and a male connector 204*c* are typically provided at opposite ends of the tool shaft 204*a* of the elongated socket tool 204. Each elongated socket tool 204 can be individually and selectively accessed for use by removal of the tool shaft 204*a* from the clip cradle 222 of the socket tool clip 220. The male connector 204*c* of the elongated socket tool 204 is attached to the ratchet mechanism on the socket wrench (not illustrated) and the socket 204*b* receives and engages a bolt or nut (not illustrated) for turning of the bolt or nut by operation of the socket wrench. After use, the male connector 204*c* may be removed from the ratchet mechanism of the socket wrench and the tool shaft 204*a* of the elongated socket tool 204 again inserted in the clip cradle 222 of the socket tool clip 220.

Figure 21:
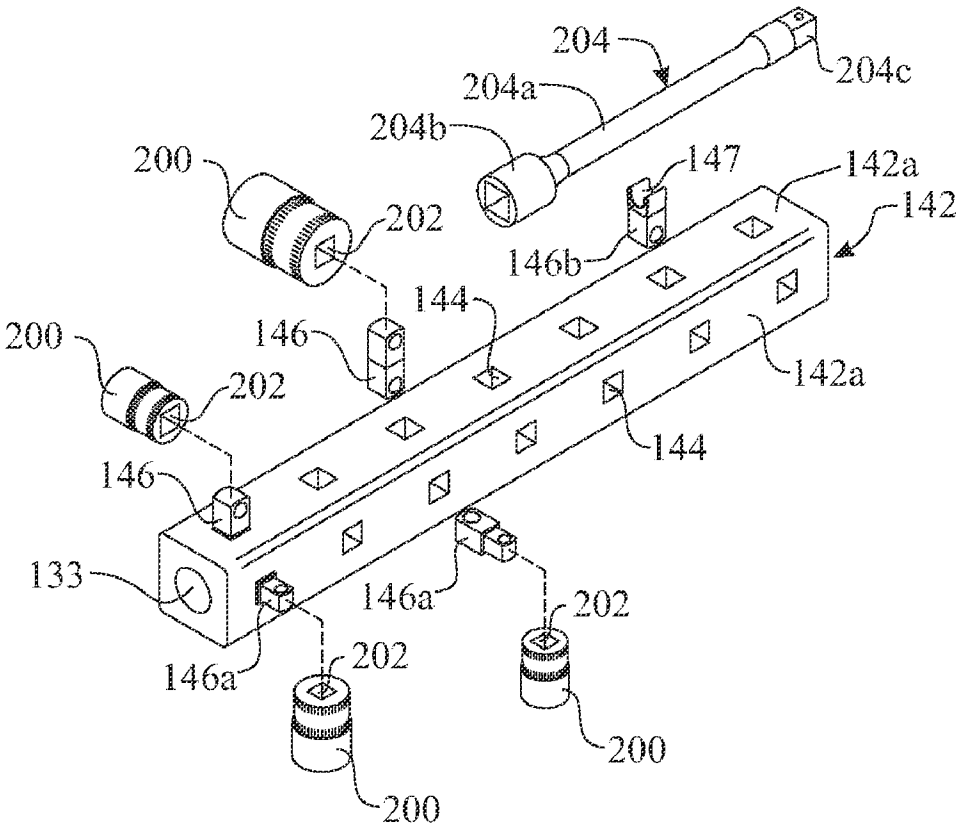
FIG. 21 is an exploded, perspective view illustrating attachment of multiple adaptors to the socket support member of the socket storage apparatus illustrated in FIG. 12E and attachment of sockets to the adaptors.
Figure 22:
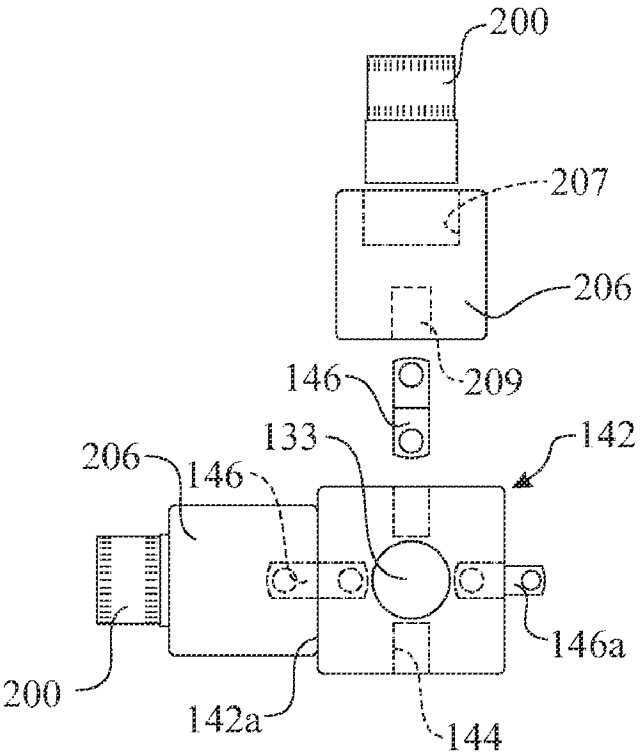
FIG. 22 is an end view of the socket support member illustrated in FIG. 21, illustrating attachment of an adaptor to the socket support member, attachment of a connector block to the adaptor and attachment of a socket to the connector block.

Referring next to FIGS. 12E, 21 and 22 of the drawings, yet another alternative illustrative embodiment of the socket storage apparatus is generally indicated by reference numeral 140. The socket storage apparatus 140 includes a pair of generally parallel, spaced-apart base panels 150. A generally elongated socket support member 142 extends between and is attached to the base panels 150 according to the knowledge of those skilled in the art. In some embodiments, the socket support member 142 may have a generally square or rectangular cross-section with multiple support member surfaces 142*a* disposed in generally perpendicular relationship with respect to each other or may have an alternative number of support member surfaces 142*a*. Multiple adaptor openings 144, each of which may be generally square or rectangular, extend into each support member surface 142*a* of the socket support member 142 in spaced-apart, adjacent relationship with respect to each other.

As illustrated in FIG. 21, in one application of the socket storage apparatus 140, multiple straight adaptors 146 and/or stepped adaptors 146*a* are inserted in each adaptor opening 144 of the socket support member 142. A socket 200 is attached to each straight adaptor 146 and/or stepped adaptor 146*a* by inserting the adaptor 146, 146*a* into the socket wrench opening 202 of the socket 200. The respective ends of the socket support member 142 may be attached to the base panels 150 (FIG. 12E) according to the knowledge of those skilled in the art. Accordingly, each socket 200 can be individually and selectively accessed for use with the socket wrench by removing the socket 200 from the corresponding adaptor 146, 146*a* and removed from the socket wrench and returned to the adaptor 146, 146*a* after use. As further illustrated in FIG. 21, at least one clip adaptor 146*b* having a curved socket clip 147 may be inserted in a corresponding adaptor opening 144 provided in the socket support member 142. The socket clip 147 of each clip adaptor 146*b* may receive the elongated tool shaft 204*a* of an elongated socket tool 204. Each elongated socket tool 204 can be individually and selectively accessed for use by removal of the tool shaft 204*a* from the socket clip 147 of the clip adaptor 146*b*. The male connector 204*c* is attached to the ratchet mechanism on the socket wrench (not illustrated) and the socket 204*b* receives and engages a bolt or nut (not illustrated) for turning of the bolt or nut by operation of the socket wrench. After use, the male connector 204*c* may be removed from the ratchet mechanism of the socket wrench and the tool shaft 204*a* of the elongated socket tool 204 again inserted in the socket clip 147 of the clip adaptor 146*b*.

Referring next to FIG. 22 of the drawings, in another application of the socket storage apparatus 140, at least one straight adaptor 146 is inserted in at least one adaptor opening 144 provided in the socket support member 142. A connector block 206 includes an adaptor opening 209 (shown in phantom), which receives the adaptor 146 and a socket cavity 207, which receives a socket 200. Multiple, adjacent connector blocks 206 may be provided on straight adaptors 146 along the length of the socket support member 142, in which case the sockets 200 attached to the respective connector blocks 206 may be arranged according to increasing or decreasing sizes of the socket openings 201 (FIG. 15) in the respective sockets 200. Accordingly, each socket 200 is accessed when needed by removal from the socket cavity 209 of the corresponding connector block 206 and may be returned to the socket cavity 209 when use is completed.

Figure 35:
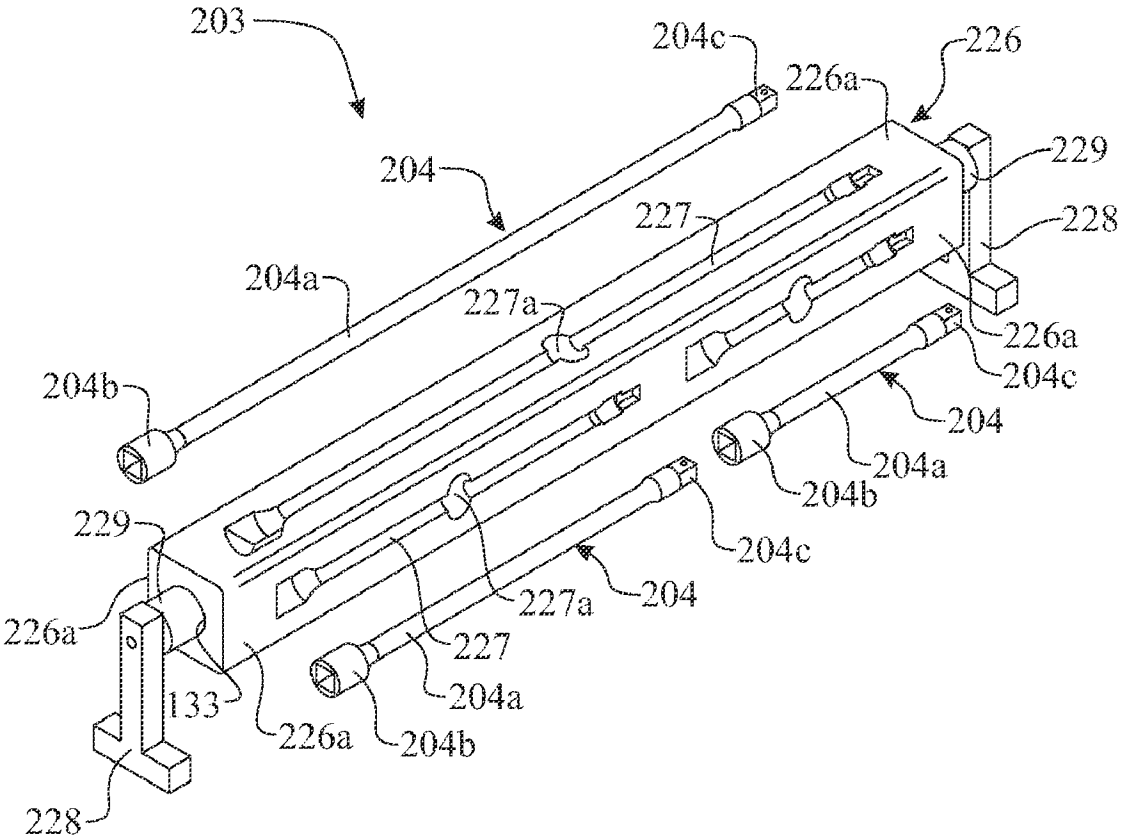
FIG. 35 is a perspective view of an alternative socket support member, with multiple socket tool cavities provided in the socket support member preparatory to seating of multiple elongated socket tools in the respective socket tool cavities for storage.

Referring next to FIG. 35 of the drawings, yet another illustrative embodiment of the socket storage apparatus 203 includes an elongated socket support member 226 which may have multiple support member surfaces 226*a* disposed in generally perpendicular relationship with respect to each other or an alternative number of support member surfaces 226*a*. At least one socket tool cavity 227 may be provided in each support member surface 226*a*. Multiple socket tool cavities 227 of various sizes may be provided in the support member surfaces 226*a*. Each socket tool cavity 227 may have the general shape of an elongated socket tool 204. The dimensions of each socket tool cavity 227 are slightly larger than the respective dimensions of the elongated socket tool 204 such that each of multiple elongated socket tools 204 of various sizes can be friction-fitted in a socket tool cavity 227 of corresponding size. An access cavity 227*a* may be provided in each socket tool cavity 227 to aid in removal of the elongated socket tool 204 from the socket tool cavity 227. The socket support member 226 may be mounted between a pair of spaced-apart stands 228. A stand insert 229 may extend from each stand 228 for insertion in an insert opening 133 provided in a corresponding end of the socket support member 226. In some embodiments, each stand insert 229 may be rotatable with respect to the corresponding stand 228 to which it is attached to facilitate rotation of the socket support member 226 between the stands 228. Accordingly, in typical application of the socket storage apparatus 203, each elongated socket tool 204 having a socket 204*b* of a selected size can be removed from the corresponding socket tool cavity 227 for use with a socket wrench (not illustrated), typically in the conventional manner. After use, the elongated socket tool 204 can be returned to the socket tool cavity 227.

Figure 36:
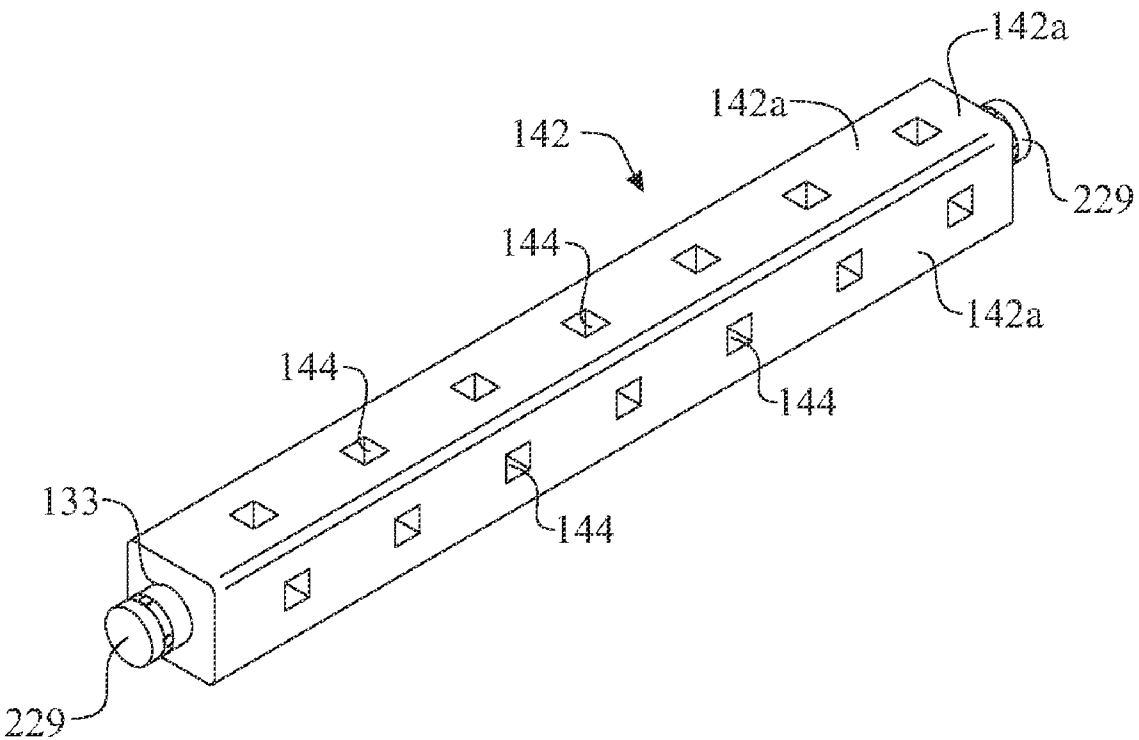
FIG. 36 is a perspective view of a socket support member of the socket storage apparatus illustrated in FIG. 12E, with a pair of stand inserts inserted in respective ends of the socket support member.

Referring next to FIG. 36 of the drawings, it will be appreciated by those skilled in the art that the socket support member of any of the socket storage apparatuses which was heretofore described with respect to FIGS. 12A-12D, such as the socket support member 142 of the socket storage apparatus 140 which was heretofore described with respect to FIG. 12E, for example and without limitation, may be fitted with a pair of stand inserts 229 for use with the stands 228 which were heretofore described with respect to FIG. 35. Each stand insert 229 may be inserted in an insert opening 133 provided in a corresponding end of the socket support member 142, after which the stand inserts 229 are engaged by the respective stands 228 to support the socket support member 142 between the stands 228.

Figure 37:
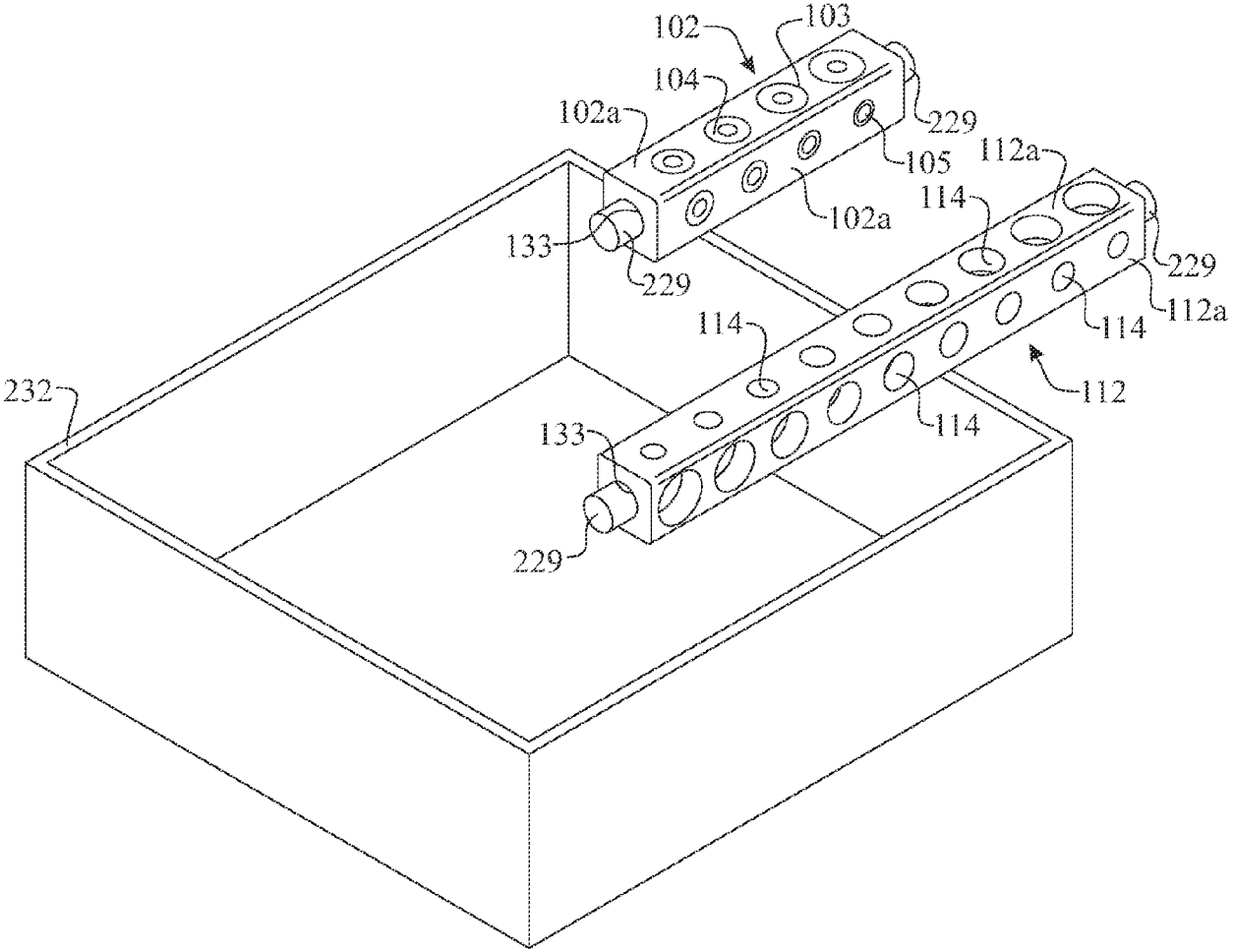
FIG. 37 is an exploded perspective view of a storage container, illustrating placement of a pair of socket support members into the storage container.
Figure 38:
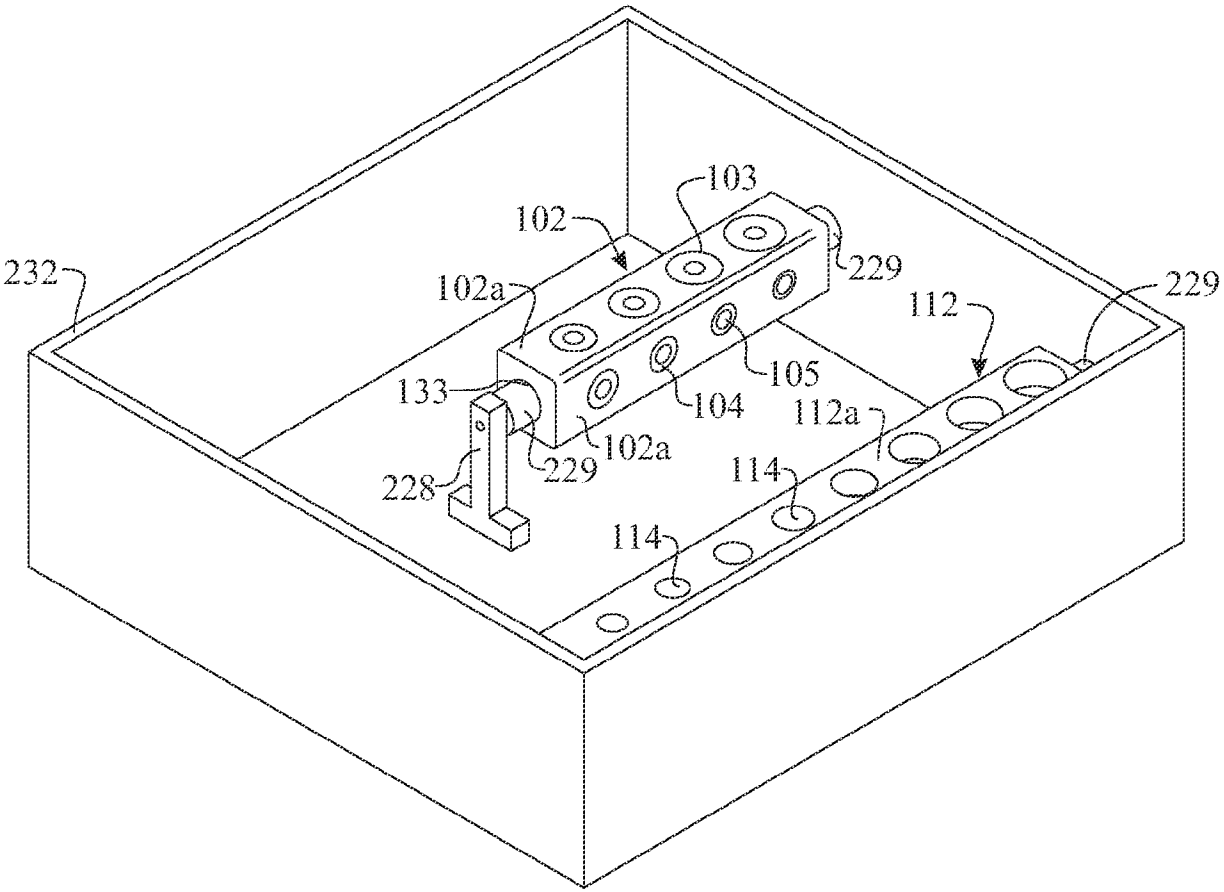
FIG. 38 is a perspective view of the storage container illustrated in FIG. 37, with the socket support members provided in the storage container.
Figure 39:
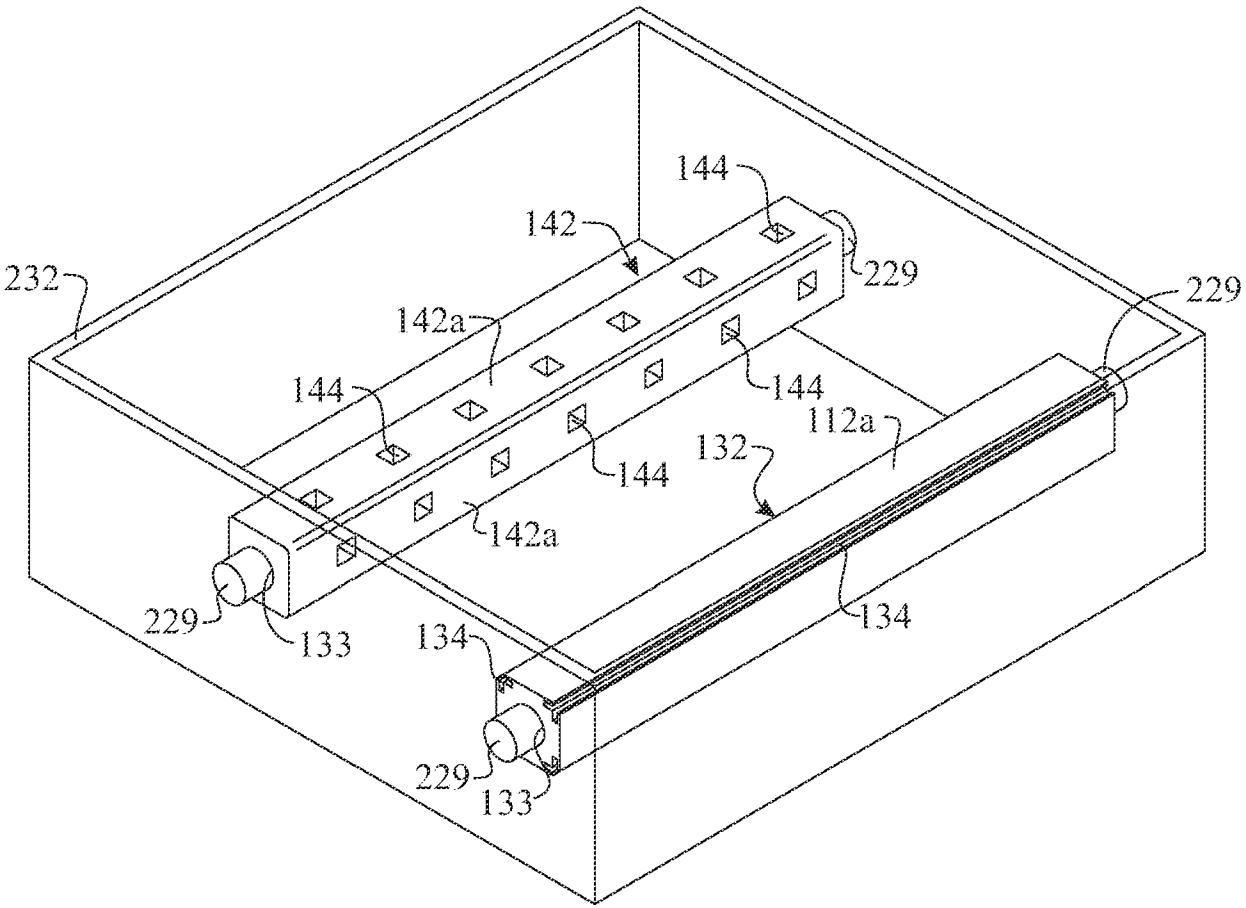
FIG. 39 is a perspective view of the storage container illustrated in FIG. 37, with an alternative pair of socket support members provided in the storage container.

Referring next to FIGS. 37-39 of the drawings, in some applications the socket support member 102 of the socket storage apparatus 100 (FIG. 12A) and the socket support member 112 of the socket storage apparatus 110 (FIG. 12B) may be mounted in a storage container 232 which may be rectangular, as shown, or any suitable alternative shape. As illustrated in FIG. 38, a stand 228 may be provided in the storage container 232 and engage a first stand insert 229 that extends from a first end of the socket support member 112. A second stand insert 229 may extend from a second end of the socket support member 112 and engage an insert opening (not illustrated) provided in the interior surface of the storage container 232. Accordingly, the socket support member 102 may be rotatably mounted between the stand 228 and the interior surface of the storage container 232. Stand inserts 229 may extend from respective ends of the socket support member 112 and insert into respective insert openings (not illustrated) provided in opposite interior surfaces of the storage container 232. Accordingly, sockets 105 can be removed from socket grommets 104 provided in the socket support member 102 for use with a socket wrench (not illustrated). Sockets (not illustrated) can also be removed from the socket openings 114 provided in the socket support member 112 for use with a socket wrench. It will be appreciated by those skilled in the art that any number or combination of the socket support members of the socket storage apparatuses illustrated in FIG. 12 can be mounted in the storage container 232 in like manner. For example, as illustrated in FIG. 39, in some applications the socket support member 132 of the socket storage apparatus 130 (FIG. 12D) and the socket support member 142 of the socket storage apparatus 140 (FIG. 12E) may be mounted together in the storage container 232.

Figure 40:
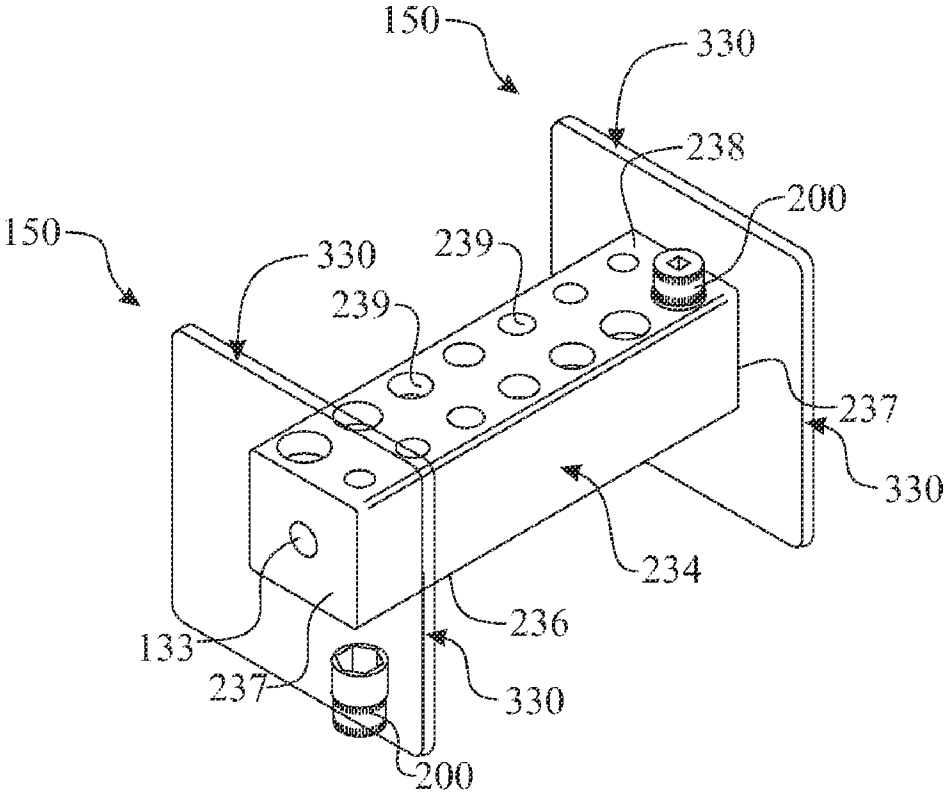
FIG. 40 is a perspective view of an alternative embodiment of a socket storage apparatus, illustrating placement of sockets into respective socket openings provided in the socket storage apparatus.
Figure 41:
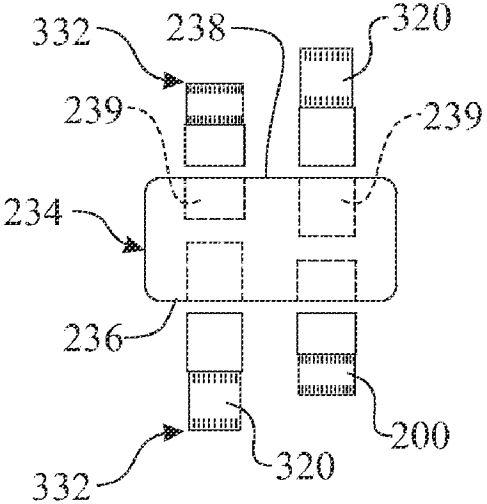
FIG. 41 is an end view of the socket storage apparatus illustrated in FIG. 40.

Referring next to FIGS. 40 and 41 of the drawings, yet another illustrative embodiment includes a socket storage apparatus 234 having a bottom surface 236 and a top surface 238 located opposing the bottom surface 236. An end surface 237 is disposed at each respective end of the socket storage apparatus 234. Multiple socket openings 239 which may have various sizes are disposed about the top panel 238. As illustrated in FIG. 41, additional socket openings 239 are disposed about the bottom panel 236. Each socket opening 239 is adapted to receive a socket 200, 320 having a socket opening 201 of corresponding size. Accordingly, the sockets 200, 320 can be placed in the socket openings 239 in order of increasing or decreasing size of the socket openings 201 of the respective sockets 200, 320. Therefore, the sockets 200, 320 are rendered accessible for use with a socket wrench (not illustrated). The sockets 200, 320 may be replaced in the socket openings 239 after use. As illustrated in FIG. 40, an insert opening 133 may be provided in each end panel 237 for attachment of the socket storage apparatus 234 to the base panels 150. A horizontal supporting edge 330 is provided about a perimeter of the base panels 150. The horizontal supporting edge 330 extends beyond a distal edge 332 of the tallest socket 320. The horizontal supporting edge 330 ensures the sockets 200, 320 remain engaged with the respective socket support platform 306 during use. Additionally, this configuration avoids any damage to the sockets 200, 320.

The present invention provides a tool holding and presenting assistant to a user, overcoming the shortcomings of the currently available socket holders. The present invention provides a means for storing a plurality of socket sets, including a variety of drive sizes, such as ¼", ⅜", ½" and the like. The holder provides for both standard and deep sizing, in a manner presenting each of a same size on opposing sides of the holder, thus simplifying the identification of the desired socket. The parallel base panels 301 provide for this opposing side configuration. In addition to storing socket sets. The present invention can be adapted to store other tool drives such as Torx bits, screw bits, Allen bits, and the like. The holder additionally provides for storage of accessories, adapters, such as extensions, and drive wrenches aiding in accessibility for the user. The preferred embodiment provides for storage of up to four (4) individual sets of sockets 320, placed along either opposing sides of two (2) socket support platforms 306 or four (s) sides of a single socket support member 142. It is recognized the system can be enhance, modifying the design from a rectangularly shaped cross section to a hexagonally shaped cross section, providing for six (6) sets of socket drives.

Figure 42:
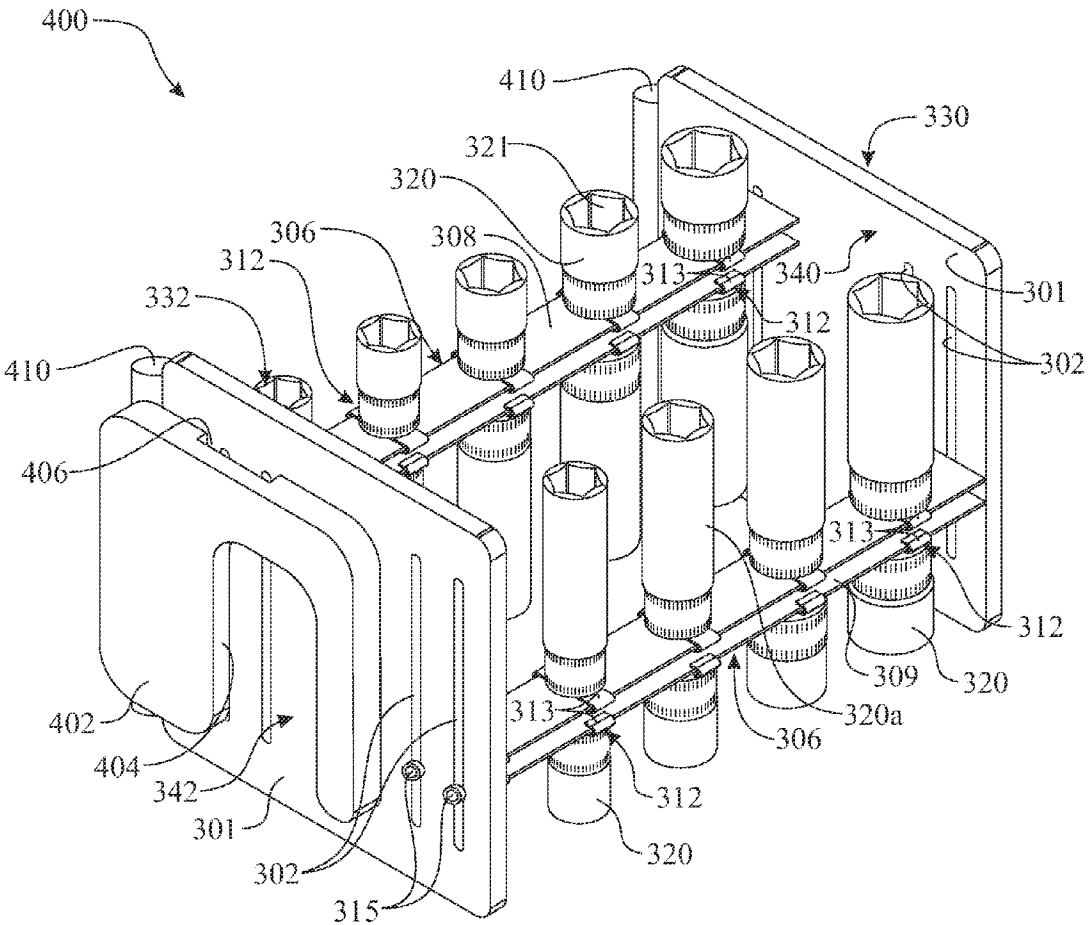
FIG. 42 is a perspective view of an optional mounting assembly for integration with the various embodiments, illustrated in a stored configuration.
Figure 43:
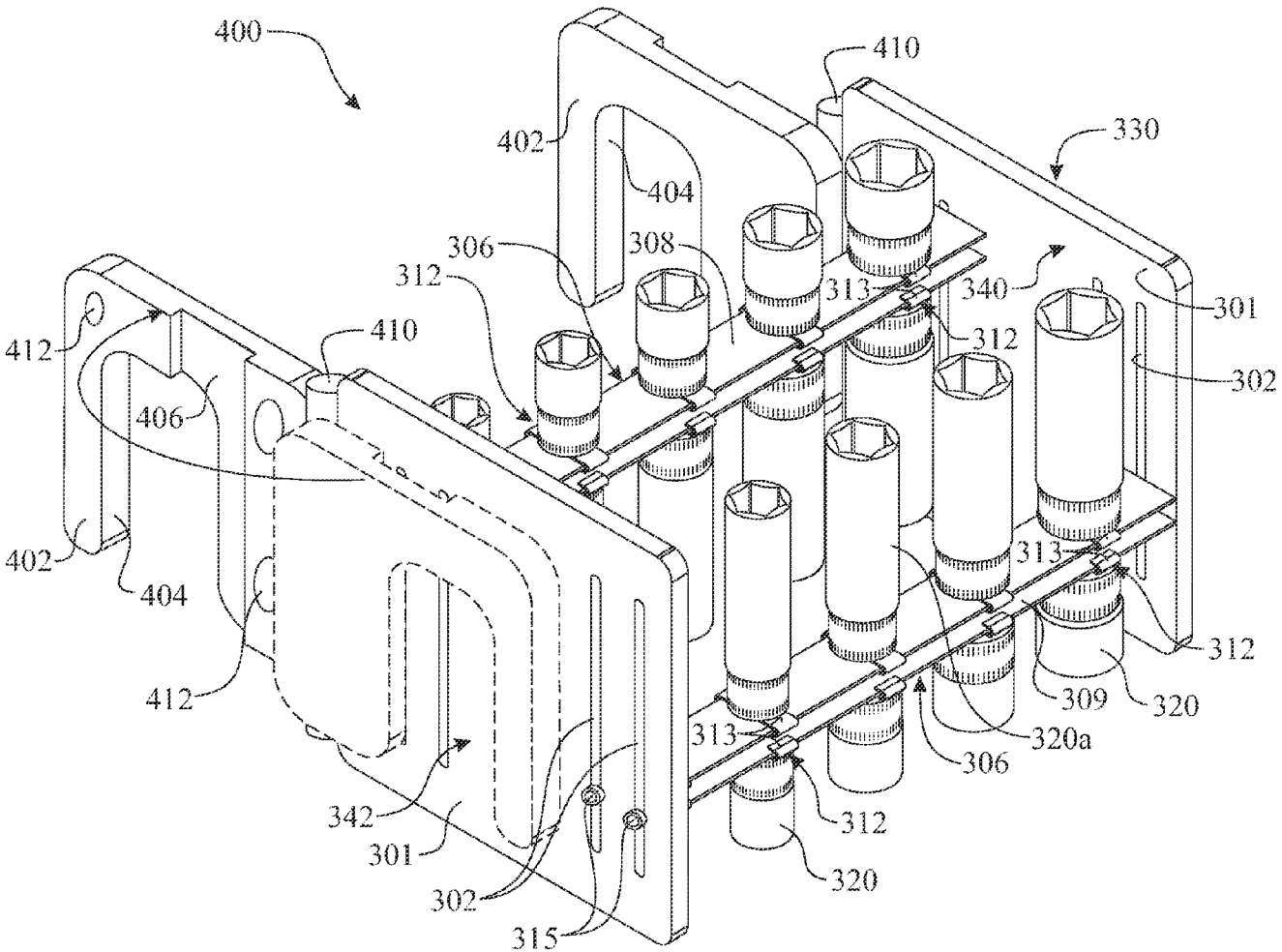
FIG. 43 is a perspective view of the optional mounting assembly of FIG. 42, illustrated in a hook mounting configuration.
Figure 44:
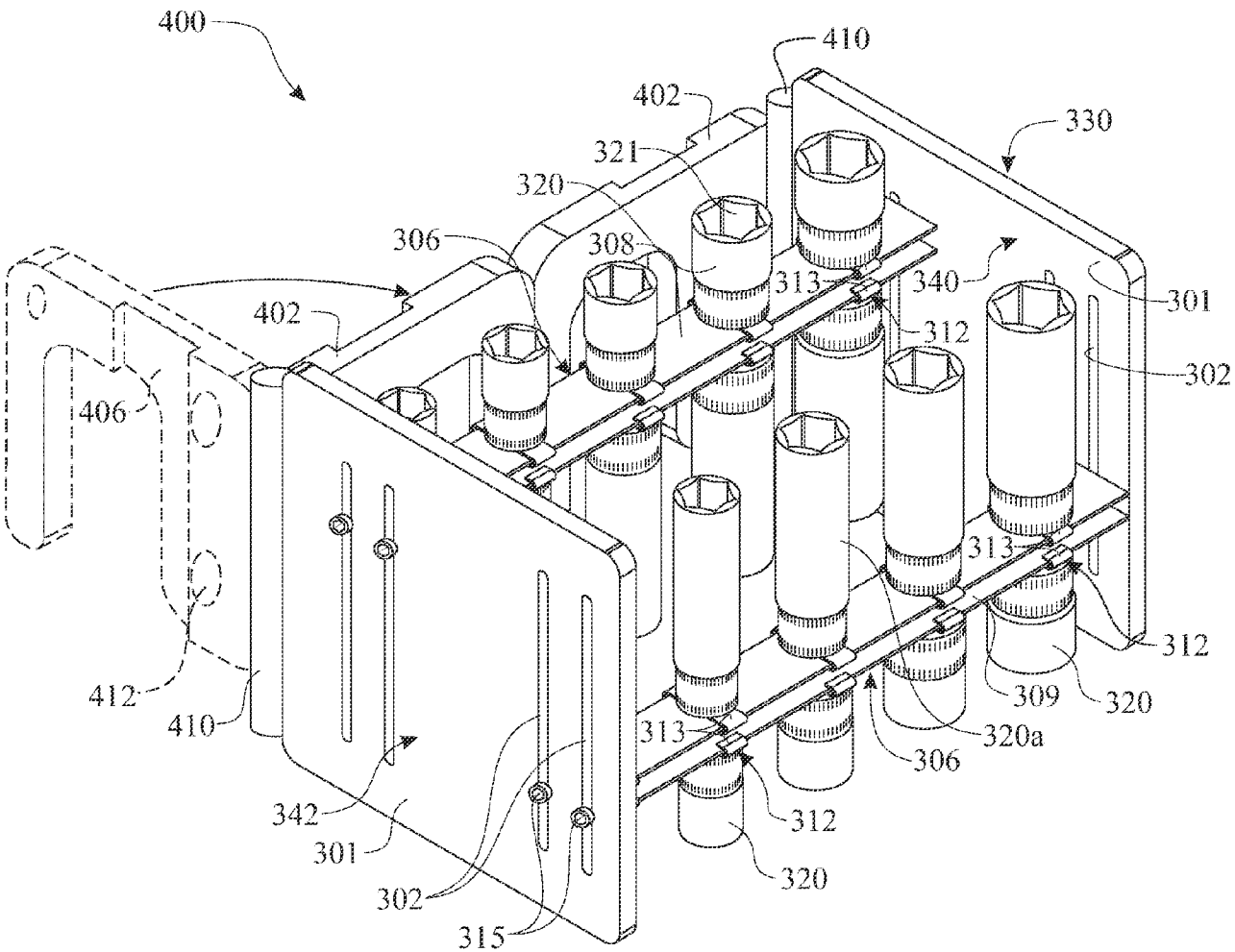
FIG. 44 is a perspective view of the optional mounting assembly of FIG. 42, illustrated in a magnet mounting configuration.

An optional hanger mounting bracket 402 can be integrated into any of the presented embodiments as illustrated in FIGS. 42 through 44. In the exemplary illustration, a pair of hanger mounting brackets 402 is pivotally coupled to the parallel base panels 301 of a mountable socket holder 400. The hanger mounting bracket 402 are rotated to a stored configuration and secured in place via a plurality of magnets 412. The magnets 412 would be assembled into pockets provided within the hanger mounting bracket 402. The hanger mounting bracket 402 can be rotated about the bracket hinge 410 to a position extending perpendicular to top platform flanges 308 as presented in FIG. 43, orienting each of the hanger hook portion 404 such to be placed over an upper edge of an object. The hanger mounting bracket 402 can continue to rotate to a position being parallel with the top platform flanges 308 as presented in FIG. 44. This allows the user to magnetically secure the mountable socket holder 400 to a magnetic object using the plurality of magnets 412, such as a sidewall of a storage cabinet. An optional adjustment clearance 406 is formed within the hanger mounting bracket 402 providing clearance for the platform fasteners 315 if required. It is understood the bracket can be provided in a variety of configurations. The bracket can be slideably assembled to the parallel base panels 301, offering a simply hanger bracket. The sliding assembly can include a hinge, wherein the bracket would slide outward, then can rotate about the hinge to be parallel to the top platform flanges 308. The parallel base panels 301 can be extended and incorporate a hook similar to the hanger hook portion 404. A magnetic plate can be hingeably assembled to the socket holder, excluding the hook feature. The parallel base panels 301 can be of a magnet material or incorporate magnets along the edges.

Figure 45:
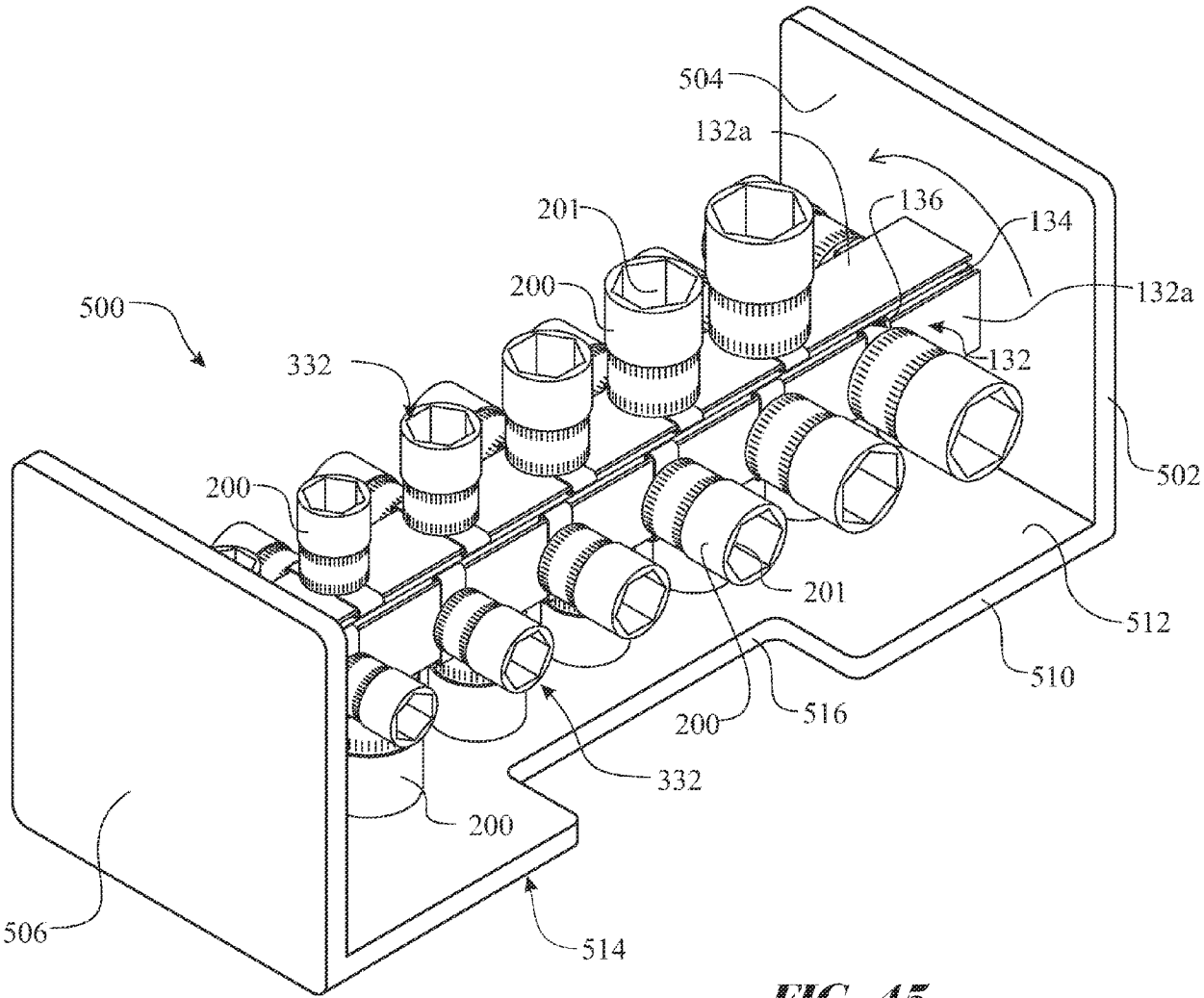
FIG. 45 is a perspective view of a first exemplary alternate base structure.
Figure 46:
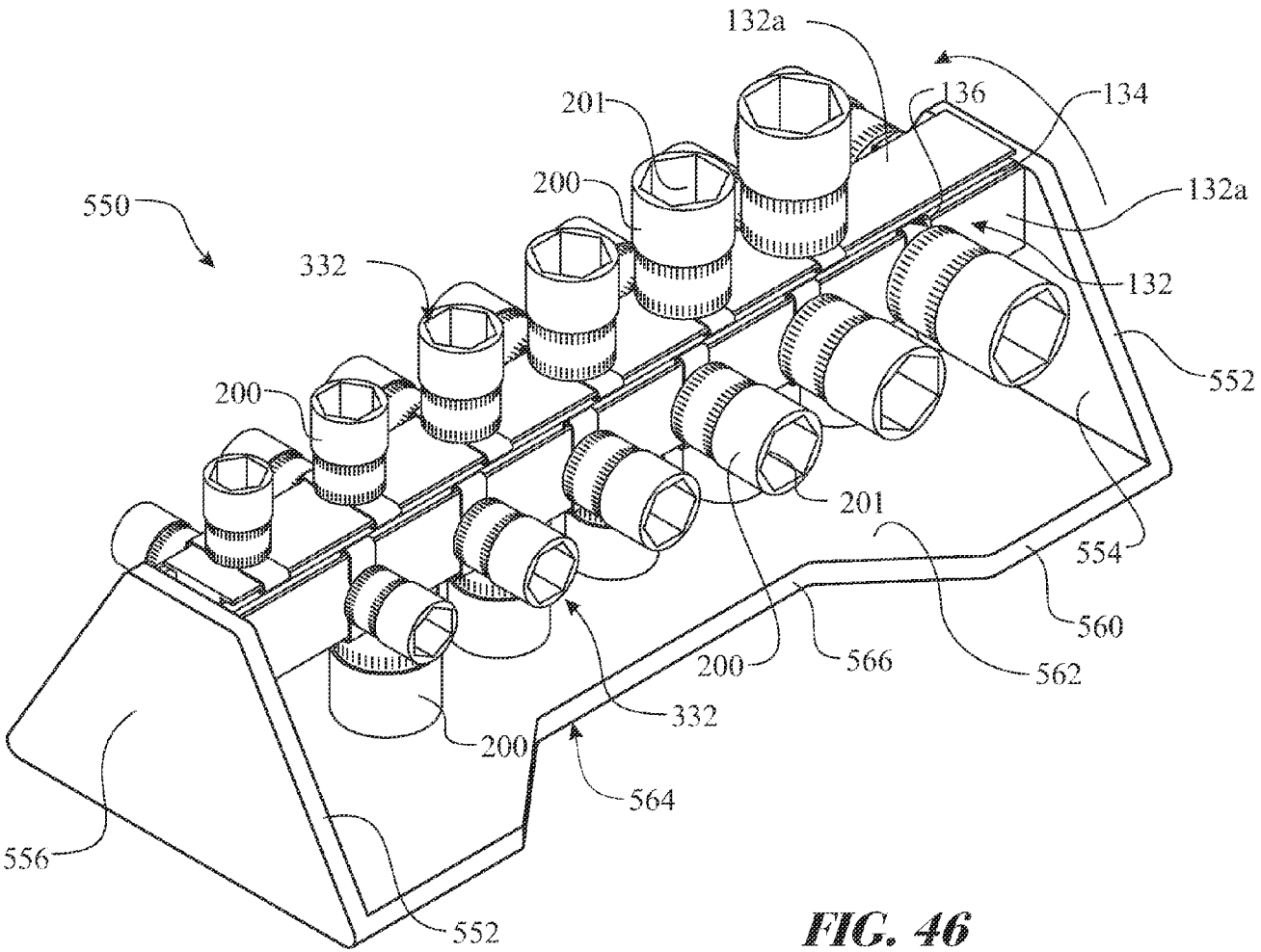
FIG. 46 is a perspective view of a second exemplary alternate base structure.

Alternate container configurations are presented in FIGS. 45 and 46. A "C" shaped frame 500 utilizes a "C" shaped frame to support the 132 as illustrated in FIG. 45. The frame is formed having a pair of vertical end walls 502 extending vertically from each end of a horizontal base portion 510. The vertical end walls 502 are defined having an interior end wall surface 504 and an exterior end wall surface 506. In the exemplary embodiment, the vertical end walls 502 is rectangular in shape and includes a top edge, which extends beyond a top edge of the vertically oriented sockets 200 and a pair of side edges, which extend beyond a top edge of the horizontally oriented sockets 200. The horizontal base portion 510 is defined having an upper surface 512 and a lower surface 514. The generally elongated socket support member 132 is assembled between the interior end wall surfaces 504 of each vertical end walls 502. The generally elongated socket support member 132 can be assembled in a manner allowing the generally elongated socket support member 132 to rotate as indicated by the illustrated arrow. Alternately, it is understood the generally elongated socket support member 132 can be assembled via a vertically adjustable configuration. A handle recess 516 can be formed within the horizontal base portion 510 providing a comfortable means for a user to carry the "C" shaped frame 500. The handle recess 516 is formed via a pair of rectangular cutouts provided along each of the two edges of the horizontal base portion 510. Magnets can be integrated into the lower surface 514 of the horizontal base portion 510 for securing the "C" shaped frame 500 to a magnetic surface.

A "C" shaped frame 550 utilizes a smaller "C" shaped frame to support the 132 as illustrated in FIG. 46. The frame is formed having a pair of vertical end walls 552 extending vertically from each end of a horizontal base portion 560. The vertical end walls 552 are defined having an interior end wall surface 554 and an exterior end wall surface 556. In the exemplary embodiment, the vertical end walls 552 are trapezoidal in shape. The vertical end walls 552 can be sized as illustrated or larger such to protect the sockets 200. The horizontal base portion 560 is defined having an upper surface 562 and a lower surface 564. The generally elongated socket support member 132 is assembled between the interior end wall surfaces 554 of each vertical end walls 552. The generally elongated socket support member 132 can be assembled to the "C" shaped frame 550 in a manner similar to those described for the "C" shaped frame 500. A handle recess 566 can be formed within the horizontal base portion 560 providing a comfortable means for a user to carry the "C" shaped frame 550. The handle recess 566 is formed via a pair of trapezoidal cutouts provided along each of the two edges of the horizontal base portion 560. Magnets can be integrated into the lower surface 564 of the horizontal base portion 560 for securing the "C" shaped frame 550 to a magnetic surface.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

I claim:

1. A socket storage apparatus for holding a selected set of sockets, the apparatus comprising:

a pair of spaced-apart end panels each having interior and exterior surfaces separated by a multi-sided perimeter edge;

at least one elongated socket-carrying member having an upper side, a lower side, and opposite ends releasably attached to respective interior surfaces of the end panels, such that the elongated socket-carrying member is maintained perpendicular to end plates;

a plurality of socket attachment members carried by the at least one elongated socket-carrying member in spaced-apart relationship to each other, each of the socket attachment members configured for carrying a pair of sockets in opposed relationship to one another along the upper and lower sides of the elongated socket-carrying member;

wherein, the selected set of sockets are attached to the socket attachment members, distal ends of the sockets do not extend beyond the multi-sided perimeter edge of the end panels.

2. A socket storage apparatus as recited in claim 1, wherein the opposite ends of the at least one elongated socket-carrying member are releasably attachable to the interior surfaces of the end plates in a manner enabling positional adjustment of the socket-carrying member.

3. A socket storage apparatus as recited in claim 2, wherein the opposite ends of the at least one elongated socket-carrying member cooperate with linear slots provided in the end panels to enable infinite positional adjustment of the elongated socket-carrying member within the slots.

4. The socket storage apparatus of claim 1 wherein said generally elongated socket support member is positioned vertically providing storage for deep sockets along a first side of said generally elongated socket support member and providing storage for standard sockets on an opposing side of said generally elongated socket support member.

5. The socket storage apparatus of claim 1 wherein said plurality of socket attachment devices comprise a plurality of socket support brackets comprises a generally curved bracket body and a pair of bracket flanges extending from said bracket body and engaging said at least one socket support member.

6. The socket storage apparatus of claim 1 wherein said plurality of socket attachment devices comprises a plurality of grommet openings provided in said at least one socket support member and a plurality of socket grommets provided in said plurality of grommet openings, respectively, and having a plurality of socket openings, respectively.

7. The socket storage apparatus of claim 1 wherein said plurality of socket attachment devices comprises a plurality of socket openings provided in said at least one socket support member.

8. The socket storage apparatus of claim 1 wherein said plurality of socket attachment devices comprises a plurality of adaptor holders carried by said at least one socket support member and a plurality of adaptors carried by each of said plurality of adaptor holders.

9. The socket storage apparatus of claim 1 wherein said plurality of socket attachment devices comprises a plurality of bracket slots provided in said at least one socket support member and a plurality of socket support brackets engaging said plurality of bracket slots.

10. The socket storage apparatus of claim 9 wherein each of said plurality of socket support brackets comprises a generally curved bracket body and a pair of bracket flanges extending from said bracket body and engaging a pair of said plurality of bracket slots.

11. The socket storage apparatus of claim 1 wherein said plurality of socket attachment devices comprises a plurality of adaptor openings provided in said socket support member and a plurality of adaptors inserted in said plurality of adaptor openings, respectively.

12. The socket storage apparatus of claim 11 further comprising a plurality of connector blocks carried by said plurality of adaptors, respectively, and a plurality of socket cavities provided in said plurality of connector blocks, respectively.

13. The socket storage apparatus of claim 1 wherein said plurality of socket attachment devices comprises a plurality of bracket slots provided in said at least one socket support member and a plurality of connector blocks having a plurality of socket cavities, respectively, engaging said plurality of bracket slots.

14. The socket storage apparatus of claim 1 wherein said plurality of socket attachment devices comprises a plurality of socket tool cavities provided in said socket support member.

15. The socket storage apparatus of claim 1 wherein said plurality of socket attachment devices comprises a plurality of bracket slots provided in said at least one socket support member and a plurality of socket tool clips engaging said plurality of bracket slots and having a plurality of clip cradles, respectively.

16. A socket storage apparatus for holding a selected set of sockets, the apparatus comprising:

a pair of spaced-apart end panels each having interior and exterior surfaces separated by a multi-sided perimeter edge;

at least one elongated socket-carrying member having an upper side, a lower side, and opposite ends releasably attached to respective interior surfaces of the end panels, such that the elongated socket-carrying member is maintained perpendicular to end plates;

a plurality of socket attachment members carried by the at least one elongated socket-carrying member in spaced-apart relationship to each other, each of the socket attachment members configured for carrying a pair of sockets in opposed relationship to one another along the upper and lower sides of the elongated socket-carrying member;

wherein, the selected set of sockets are attached to the socket attachment members, entire bodies of the sockets do not extend beyond the multi-sided perimeter edge of the end panels.

17. The socket storage apparatus of claim 16 wherein said plurality of socket attachment devices is a plurality of socket attachment devices selected from the group consisting of a plurality of socket support brackets, a plurality of grommet openings provided in said socket support member and a plurality of socket grommets having a plurality of socket openings provided in said plurality of grommet openings, a plurality of socket openings provided in said socket support member, a plurality of adaptor holders carried by said at least one socket support member and a plurality of adaptors carried by each of said plurality of adaptor holders, a plurality of bracket slots provided in said at least one socket support member and a plurality of socket support brackets engaging said plurality of bracket slots and a plurality of adaptor openings provided in said socket support member and a plurality of adaptors inserted in said plurality of adaptor openings, respectively.

* * * * *